US007292235B2

(12) United States Patent
Nose

(10) Patent No.: US 7,292,235 B2
(45) Date of Patent: Nov. 6, 2007

(54) CONTROLLER DRIVER AND DISPLAY APPARATUS USING THE SAME

(75) Inventor: Takashi Nose, Tokyo (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 655 days.

(21) Appl. No.: 10/857,914

(22) Filed: Jun. 2, 2004

(65) Prior Publication Data

US 2004/0246244 A1 Dec. 9, 2004

(30) Foreign Application Priority Data

Jun. 3, 2003 (JP) ..... 2003/158444

(51) Int. Cl.
*G09G 5/00* (2006.01)

(52) U.S. Cl. ..... 345/204; 345/1.1; 345/531; 345/532; 345/544; 348/564; 348/571; 348/588

(58) Field of Classification Search ..... 345/1.1, 345/204, 531, 532, 544; 348/564, 571, 588
See application file for complete search history.

(56) References Cited

U.S. PATENT DOCUMENTS 5,179,642 A * 1/1993 Komatsu ..... 345/634
5,307,055 A * 4/1994 Baskin et al. ..... 345/2.2
5,914,728 A * 6/1999 Yamagishi et al. ..... 345/565
6,288,751 B1 * 9/2001 Yatomi et al. ..... 348/565
6,417,886 B1 * 7/2002 Tariki ..... 348/384.1

FOREIGN PATENT DOCUMENTS

| | | |
|---|---|---|
| JP | 07-152905 | 6/1995 |
| JP | 07-295937 | 11/1995 |
| JP | 09-081084 | 3/1997 |
| JP | 09-281950 | 10/1997 |
| JP | 10-074064 | 3/1998 |
| JP | 2001-222276 | 8/2001 |

* cited by examiner

*Primary Examiner*—Bipin Shalwala
*Assistant Examiner*—Vincent E. Kovalick
(74) *Attorney, Agent, or Firm*—McGinn IP Law Group, PLLC

(57) ABSTRACT

A control driver includes a display memory control section which generates a first process control signal when image data includes only first image data which has a pixel size equal to or smaller than that of a display section, and generates a second process control signal when the image data includes first image data and second image data and the first image data has a pixel size equal to that of the display section, and a display memory section which stores upper and lower portions of the first image data as first and second portions of display data in response to the first process control signal, and stores the upper portion of the first image data and an upper portion of the second image data as the first and second portions of the display data in response to the second process control signal. The display data is displayed on the display section.

28 Claims, 21 Drawing Sheets

Fig. 7

| 1ST SELECT SIGNAL SELECT1 | 2ND SELECT SIGNAL SELECT2 | 1ST SELECTOR SECTION OUTPUT | 2ND SELECTOR SECTION OUTPUT | 3RD SELECTOR SECTION OUTPUT |
|---|---|---|---|---|
| L | L | 1ST IMAGE DATA LOWER PORTION | -- | -- |
| L | H | 1ST IMAGE DATA LOWER PORTION | 1ST DISPLAY MEMORY DATA | 2ND DISPLAY MEMORY DATA |
| H | H | 2ND IMAGE DATA UPPER PORTION | 1ST DISPLAY MEMORY DATA | 1ST DISPLAY MEMORY DATA |
| H | H | 2ND IMAGE DATA UPPER PORTION | 2ND DISPLAY MEMORY DATA | 2ND DISPLAY MEMORY DATA |

CONTROLLER DRIVER AND DISPLAY APPARATUS USING THE SAME

BACKGROUND OF THE INVENTION

1. Field of the Invention

The present invention relates to a control driver and a display apparatus using the same.

2. Description of the Related Art

In recent years, mobile terminals such as a portable phone and a PDA (Personal Digital Assistant) are developed to have various useful functions, and various data can be displayed on a display screen of the mobile terminal. For example, the portable phone is provided with an E-mail function, a web viewing function, a photography function, an animation display function and so on, in addition to the telephone communication function. Image data of a large size can be displayed on the display screen of the portable phone in addition to text data.

FIG. 1 is a block diagram showing the mobile terminal to which a conventional control driver is applied. Referring to FIG. 1, the mobile terminal is composed of a display unit and an input unit (not shown). The input unit is operated by a user. The display unit is composed of an image drawing unit 101, a control driver 102, a display section 103, a gradation voltage generating circuit 104 and a gate line drive circuit 105. A CPU is exemplified as the image drawing unit 101. The control driver 102 is composed of a latch section (not shown), a memory control circuit 106, a display memory section 107, a latch section 108, a data line drive circuit 109 and a timing control circuit 110.

The image drawing unit 101 transfers the image data to the control driver 102, and the display memory section 107 stores the image data. The number of bits of each of pixels of the image data is 2 or more, and it is supposed that the number of bits of each pixel is 8 in this example. The display section 103 has the pixels which are defined by data lines and gate lines and arranged in a matrix. The display section 103 displays the image data for one screen.

The image drawing unit 101 outputs a timing control signal as a clock signal to the timing control circuit 110. The timing control circuit 110 generates and outputs timing signals to the memory control circuit 106, the latch section 108 and the gate line drive circuit 105 in response to the timing control signal from the image drawing unit 101. The memory control circuit 106, the latch section 108 and the gate line drive circuit 105 operate in synchronism with the timing signal.

The image drawing unit 101 outputs a memory control signal to the memory control circuit 106, when the image drawing unit 101 transfers the image data to the control driver 102. The memory control signal contains an image data size signal, and signals to control write and read operations of the image data into and from the display memory section 107. The memory control circuit 106 outputs a write control signal containing a write signal and an address to the display memory section 107 in response to the timing signal and the memory control signal. Thus, the image data from the image drawing unit 101 is stored in the display memory section 107. Also, when the image data is to be displayed on the display section 103, the image drawing unit 101 generates and output the memory control signal to the memory control circuit 106. The memory control circuit 106 generates and outputs a read control signal containing a read signal and an address to the display memory section 107 in response to the timing signal and the memory control signal. Thus, the image data is read out from the display memory section 107 for one display line, and the latch section 108 latches the image data for the one display line. The latch section 108 outputs the display data to the data line drive circuit 109 in response to the timing signal. The gradation voltage generating circuit 104 generates and outputs the gradation voltages for gradation-display of the display data to the data line drive circuit 109. The data line drive circuit 109 inputs the display data from the latch section 108, and drives the data lines of the display section 103 based on the display data and the gradation voltages from the gradation voltage generating circuit 104.

Now, it is supposed that the size of the image data is not larger than a size of the screen of the display section 103. In this case, in a write operation, the image drawing unit 101 transfers the image data to the control driver 102 in synchronism with the timing signal. The image data supplied from the image drawing unit 101 is stored in the display memory section 107 in response to the write control signal from the memory control circuit 106. In a read operation, when the image data is to be displayed to the display section 103, image data for one gate line is read out from the display memory section 107 in response to the read control signal supplied from the memory control circuit 106. The image data for the one gate line is latched by the latch section 108, and then displayed on the display section 103.

From a demand of miniaturization of the mobile terminal, the pixel size of the screen of the display section 103 is limited. When the mobile terminal receives the image data (containing an E-mail) having a size larger than the pixel size of the screen of the display section 103, the mobile terminal can not display the whole of image data on the display section 103. Therefore, the mobile terminal displays the image data while switching the display in response to a scroll instruction from the user. Now, it is supposed that the size of the image data is larger than that of the screen of the display section 103, and is composed of first image data and second image data.

In a first process when the size of the image data is larger than that of the screen of the display section 103, the image drawing unit 101 transfers the first image data to the control driver 102 in synchronism with the timing signal. The first image data is stored in the display memory section 107 in response to the display memory control signal from the memory control circuit 106.

In the first process, when the first image data is displayed on the display section 103, the image data for a gate line is read out from the display memory section 107 in response to the read memory control signal from the memory control circuit 106. The image data for the gate line read out from the display memory section 107 is outputted to the latch section 108 as display line data. The latch section 108 latches the display line data.

When the user to operates the input unit such that the second image data is to be displayed on the display section 103, a scroll instruction is issued and a second process is carried out. In the second process, the image drawing unit 101 transfers the second image data to the control driver 102 in synchronism with the timing signal. The second image data is stored in the display memory section 107 based on the write control signal from the memory control circuit 106.

In the second process, when the second image data is displayed on the display section 103, the image data for a gate line is read out from the display memory section 107 in response to the read control signal from the memory control circuit 106. The image data for the gate line read out from the display memory section 107 is outputted to the latch section 108 as the display line data. The latch section 108 latches the display line data.

FIG. 2 is a block diagram showing the structure of the display memory section 107 and the latch section 108 in the conventional control driver. The display memory section 107 contains a word line decoder 121 as a row decoder, a bit line decoder 122 as a column decoder, and memory cells 26. Word lines WLi 123 ($1 \leqq i \leqq m$, m is the number of gate lines of the display section 103) are connected with the word line decoder 121. Pairs of bit lines Bj(k) 125 and Bj'(k) 125' ($1 \leqq j \leqq n$, n is the number of data lines of the display section 103, $0 \leqq k \leqq p$, p is the number of bits of the image data) are connected with the bit line decoder 122. Each memory cell 26 is defined by the word line and the pair of bit lines. The memory cells 26 are arranged in a matrix in a row direction and a column direction. The memory cells 26 are allocated in order from the most significant bit (bit 7) to the least significant bit (bit 0) for each pixel in a row direction. A sense amplifier 128(*k*) is provided for each of columns of the memory cells 26.

The latch section 108 contains a plurality of latch circuits. The latch circuits of the latch section 108 are provided for the columns of the memory cells 26 in order from the most significant bit to the least significant bit.

FIG. 3 is a circuit diagram showing the structure of a part of the display memory section 107 in the conventional control driver. FIG. 3 shows the columns for the bit 7 and bit 6, and the structures of the columns for the bit 7 to bit 0 in the display memory section 107 are the same. The columns contain a column selection section, a memory cell section, a precharge circuit section and a sense amplifier section. The structure of the column of the bit 7 will be described.

Referring to FIG. 3, in the column selection section, the bit 7 of a pixel of the image data latched by the latch section (not shown) is connected with bit lines Bj(7) of a pair via a switch SW111 and with the bit line Bj'(7) of the pair via an inverter I111 and a switch SW112. The switches SW111 and SW112 are turned on in response to the write signal WT supplied to the memory control circuit 106.

In the memory cell section, each of the memory cells 26 in the column of the memory cells for the bit 7 is connected with a corresponding word line WLi. Each memory cell 26 contains an N-channel MOS transistor T111, a latch element and an N-channel MOS transistor T112, which are connected in series between the bit lines Bj(7) and Bj'(7) of the pair. The latch element contains two inverters I112 and I113, which are connected in parallel in opposite directions. The gates of the N-channel MOS transistors T111 and T112 are connected with the corresponding word line WLi. The word line decoder 121 decodes a Y address of the write or read control signal to select one of the word lines WLi. also, the memory cell section is connected with the precharge circuit section via switches SW121 and SW122. The switches SW121 and SW122 are turned on a sense precharge control signal SPC supplied from the memory control circuit 106.

In the precharge circuit section, two P-channel MOS transistors T121 and T122 are connected between the bit lines Bj(7) and Bj'(7) of the pair, and a node between the two P-channel MOS transistors T121 and T122 is connected with the power supply voltage VDD. The gates of the two P-channel MOS transistor T121 and T122 are connected with a precharge signal PCB supplied from the memory control circuit 106. Thus, when the two P-channel MOS transistors T121 and T122 are turned on in response to the precharge signal PCB, the bit lines are precharged. Also, a P-channel MOS transistor T123 is connected between the bit lines Bj(7) and Bj'(7) of the pair. The gate of the P-channel MOS transistor T123 is connected with the precharge signal PCB. Thus, the potentials of the bit lines are equalized in response to the precharge signal PCB.

In the sense amplifier section, two P-channel MOS transistors T124 and T125 are connected between the bit lines Bj(7) and Bj'(7) of the pair, and a node between the two P-channel MOS transistors T124 and T125 is connected with the power supply voltage VDD via a switch SW131. Also, two N-channel MOS transistors T113 and T114 are connected between the bit lines Bj(7) and Bj'(7) of the pair, and a node between the two N-channel MOS transistors T113 and T114 is connected with the ground GND via a switch SW132. The gates of the P-channel MOS transistor T125 and N-channel MOS transistor T114 are connected with the bit line Bj(7) of the pair, and the gates of the P-channel MOS transistor T124 and N-channel MOS transistor T113 are connected with the bit line Bj'(7) of the pair. The switches SW131 and SW132 are turned on in response to a sense amplifier enable signal SE supplied from the memory control circuit 106. Thus, when the potential of the bit line Bj(7) is higher than that of the bit line Bj'(7), the P-channel MOS transistor T124 goes to the ON state and the P-channel MOS transistor T125 goes to the OFF state. Also, the N-channel MOS transistor T113 goes to the OFF state and the N-channel MOS transistor T113 goes to the ON state. In this way, a difference of the potentials on the bit line Bj(7) is amplified.

In the sense amplifier section, a flip-flop of NAND gates N111 and N112 is provided and connected with the bit line Bj(7) of the pair via switches SW141 and SW142. The switches SW141 and SW142 are turned on in response to the read signal RD supplied from the memory control circuit 106. Thus, the potential difference is latched by the flip-flop. The output of the NAND gate N111 is connected with an inverter I114, and the output of the flip-flop is outputted to the latch section 108 via the inverter I114.

Next, the write operation of the first process in the conventional control driver when the size of image data is not larger than that of the screen of the display section 103 will be described with reference to FIGS. 4A to 4G. The image data is transferred from the image drawing unit 101 to the control driver 102 in synchronism with the timing signal, and latched by a latch section (not shown). The control driver 102 carries out the write operation of image data during the write period 0 to a4 in response to the display memory control signal from the memory control circuit 106. The display memory control signal contains a write signal WT, an X address, a Y address, a sense precharge control signal SPC, and a precharge signal PCB. The write period contains a precharge period, a data determination period and a data write period. The precharge period is a period 0 to a1, the data determination period is a period a1 to a2, and the data write period is a period a2 to a3.

Referring to FIGS. 4D and 4E, in the precharge period of the first process, the memory control circuit 106 sets the sense precharge control signal SPC to the high level and the precharge signal PCB to the low level in response to the memory control signal. As a result, the switches SW121 and SW122 are turned on to connect the bit lines Bj(7) and Bj'(7) of the memory cell section with the bit lines of the precharge section. Also, the P-channel MOS transistors T121, T122 and T123 are turned on so that the bit lines are precharged to a predetermined potential, and equalized.

Subsequently, in the data determination period, the signal SPC is set to the low level and the signal PCB is set to the high level. As a result, the switches SW121 and SW122 are turned off, and the P-channel MOS transistors T121, T122, and T123 are also turned off. Also, the image data latched by the latch section is supplied to the display memory section 107 in response to the timing signal. The bit line decoder 122 of the display memory section 107 decodes the X address of the display memory control signal and drives data bits based on the decode result, as shown in FIG. 4A.

Subsequently, in the data write period, as shown in FIGS. 4B and 4C, the switches SW111 and SW112 are turned on in response to the write signal WT so that the data bits are connected with the bit lines Bj and Bj' of the pairs. As a result, the bit lines of the pair are set to different potentials based on the corresponding data bit. The word line decoder 121 of the display memory section 107 decodes the Y address to set one of the word lines to the high level to drive the word line WL1. As a result, for example, the N-channel MOS transistors T111 and T112 of the memory cell C11(7) are turned on. Thus, the data bit is latched or stored by the latch element.

Subsequently, at the time a3 of the data write period, the write signal WT is set to the low level so that the switches SW111 and SW112 are turned off. Also, the word line decoder 121 of the display memory section 107 sets the word line WL1 to the low level so that the N-channel MOS transistors T111 and T112 are turned off.

Subsequently, at the time a4, the sense precharge control signal SPC and the precharge signal PCB are set to the high level and the low level again, respectively. Thus, the write operation can be repeated.

Next, a read operation of the first process in the conventional control driver will be described. FIGS. 5A to 5G are timing charts showing the read operation in the conventional control driver. The memory control circuit 106 outputs the display memory control signal in response to the memory control signal. The display memory control signal contains a read signal RD, an X address, a Y address, the sense precharge control signal SPC, the precharge signal PCB, and a sense amplifier enable signal SE. A period 0 to b5 of the read operation contains a precharge period, a data read operation period, a sense operation period and a data output period. The precharge period is a period 0 to b1, the data read operation period is a period b1 to b2, the sense operation period is a period time b2 to b3, the data output period is period b3 to b4, and another period b4 to b5 is provided.

As shown in FIG. 5E, in the precharge period of the first process, the sense precharge control signal SPC is set to the high level so that the switches SW121 and SW122 are turned on to connect the bit lines Bj(7) and Bj'(7) of the memory cell section with the bit lines of the precharge section. Also, the precharge signal PCB is set to the low level. As a result, the P-channel MOS transistors T121, T122 and T123 are turned on so that the bit lines Bj(7) and Bj'(7) are precharged to predetermined potentials which are equalized.

Subsequently, in the data read operation period of the first process, the signal PCB is set to the high level. As a result, the P-channel MOS transistors T121, T122, and T123 are turned off, as shown in FIG. 5E, and the precharge operation is completed. The bit line decoder 122 selects all the bit line pairs based on the X address. Also, one of the word lines WLi is selected and driven to the high level by the word line decoder 121 based on the Y address, as shown in FIG. 5C. Thus, for example, the N-channel MOS transistors T111 and T112 connected with the word line WL1 are turned on. As a result, the data bit latched by the latch element of the memory cell C11(7) is outputted onto the bit lines Bj(7) and Bj'(7) of the pair.

Subsequently, in the sense operation period of the first process, as shown in FIG. 5D, the sense precharge control signal SPC is set to the low level so that the bit lines of the memory cell section is disconnected from the bit lines in the precharge circuit section and the sense amplifier section. At this time, the potentials of the bit lines in the precharge circuit section and the sense amplifier section are set sufficiently based on the data bit. As shown in FIG. 5E, the sense amplifier enable signal SE supplied from the memory control circuit 106 is set to the high level so that the switches SW131 and SW132 are turned on. Thus, the difference between the potentials on the bit lines is amplified.

Subsequently, in the data output period of the single transfer process, as shown in FIG. 5G, the read signal RD is set to the high level by the memory control circuit 106 so that the switches SW141 and 142 are turned on. As a result, the potential states on the bit lines are latched by the flip-flop. Then, the read out bit data is outputted from the inverter I114.

Then, during the data output period, the sense amplifier enable signal SE is set to the low level. Thereafter, at the time b4, the selected word line and the read signal are set to the low level. Thus, the bit data can be read out.

At the time b5, the precharge signal PCB is set to the low level again to repeat the read operation.

As described above, in the mobile terminal, when the size of the image data is larger than the size of the screen of the display section 103 and has the first image data and the second image data, the image drawing unit 101 transfers the first image data, the control driver 102 stores the first image data in the display memory section 107, and the first image data is displayed on the display section 103. When a scroll instruction is issued in response to an operation of the input unit by the user, the image drawing unit 101 transfers the second image data, the control driver 102 stores the second image data in the display memory section 107, and the second image data is displayed on the display section 103. In the mobile terminal, the first image data or the second image data is transferred every time the scroll instruction is issued, and stored in the display memory section 107. For this reason, the power consumption has become large.

For example, the image data is supposed to be an E-mail. In this case, when the mobile terminal receives the E-mail with a message longer than a usual message, there is a problem that the user (the user) can not understand the whole message once because the whole message can not be displayed on the display section 103.

In Japanese Laid Open Patent Application (JP-A-Heisei 9-281950), a method of storing message data in a display memory section as a bit map is disclosed. The content of the display memory is shifted in accordance with a scroll operation. In this case, in order to prevent increase of the consumption power when the image data is stored in the display memory every time a screen is scrolled, only the pixels of the changed image data are transferred from the image drawing unit, resulting in reduction of the consumption power. However, in this conventional example, even if the consumption power per the transfer reduces, the consumption power has become large every time the scroll instruction is carried out. The increase of the consumption power is a large problem for the mobile terminal. In order to maintain the available time during which the scroll instruction can be used, the power supply must have a large size. It damages the characteristic of the mobile terminal, i.e., the smallness and light weight.

Also, a method of increasing the memory capacity of a display memory is disclosed in Japanese Laid Open Patent Application (JP-A-Heisei 7-295937). In this conventional example, an image memory is provided to have a larger capacity than the capacity of the display memory. A mouse ball is provided to detect a quantity of movement and a direction of the movement in a scroll operation. A calculation process section improves the scroll operability by reading the movement data. In this conventional example, the image data which has an area wider than the display area of a display section is stored in the image memory and a display position on the image memory is changed when the scroll is carried out. Therefore, in this conventional example, it is sufficient that the image data transfer is carried out once. However, because the chip area increases by increasing the memory capacity of the display memory, resulting in increase of the cost of the chip.

Also, an image data processing apparatus is disclosed in Japanese Laid Open Patent Application (JP-A-Heisei 7-152905). In this conventional example, a memory section is provided to store image data. An address generating section generates an address to specify a storage position of the image data stored in the memory section. An address control section is provided to control the address generating section such that a specification order of the addresses generated by the address generating section is controlled to control an output order of the image data from the memory section.

Also, a method of a display apparatus is disclosed in Japanese Laid Open Patent Application (JP-A-Heisei 9-81084). In this conventional example, a part of display data is given in a scroll display, and a control unit controls for it to be displayed on a predetermined partial region of an image display apparatus. Thus, a time for updating a display screen is made short in the scroll display. Also, during the scroll display, a quantity of data to be transferred is reduced.

Also, a matrix display unit is disclosed in Japanese Laid Open Patent Application (JP-A-Heisei 10-74064). The matrix-type display unit of this conventional example aims at reduction of consumption power. A plurality of display pixels are arranged in a matrix in 2-dimensional directions of display screen. A plurality of wiring lines are arranged in horizontal and vertical directions. A plurality of first storage elements stores first display data in response to a first screen display timing. A motion detection section compares the first display data and second display data to detect existence or non-existence of a motion of an image, when the second display data is supplied to a second screen display timing subsequent to the first screen display timing. A calculation section determines a motion quantity of the image in a pixel unit when the motion of the image is detected. A display control section controls such that a part of the second display data is displayed on a position corresponding to the detected motion quantity when the motion of the image is detected, and a part of the first display data is displayed on the original position.

Also, a display unit is disclosed in Japanese Laid Open Patent Application (JP-P2001-222276A). In this conventional example, the display unit contains a RAM built-in driver. First and second bus lines transfer a still picture data and a video picture. A RAM stores the still picture data and the video picture data. A first control circuit carries out a write control and a read control to the RAM. A second control circuit operates independently from the first control circuit and carries out a read control of the still picture data and the video picture data as display data, and drives a display section.

SUMMARY OF THE INVENTION

An object of the present invention is to provide a control driver, a display apparatus using the control driver, and a mobile terminal using the display apparatus, which can display image data on a display section without increasing consumption power.

Another object of the present invention is to provide a control driver, a display apparatus using the control driver, and a mobile terminal using the display apparatus, which can display image data on a display section without increasing the memory capacity of a display memory.

Another object of the present invention is to provide a control driver having a small size, a display apparatus using the control driver, and a mobile terminal using the display apparatus.

In an aspect of the present invention, a control driver is composed of a display memory control section and a display memory section. The display memory control section generates a first process control signal when image data comprises only fist image data which has a pixel size equal to or smaller than that of a display section, and generates a second process control signal when the image data comprises first image data and second image data and the first image data has a pixel size is equal to that of the display section. The display memory section stores upper and lower portions of the first image data as first and second portions of display data in response to said first process control signal, and stores the upper portion of said first image data and an upper portion of the second image data as the first and second portions of the display data in response to the second process control signal. The display data is displayed on the display section.

In another aspect of the present invention, a control driver includes a display memory section, first to third selector sections and a latch section. The display memory section stores first and second portions of display data. The first and second portions are upper and lower portions of a first image data in a first process, and the first and second portions are the upper portion of the first image data and an upper portion of a second image data in a second process, and the first image data has a same pixel size as that of a display section on which the display data is displayed. The first selector section outputs as the second portion, the lower portion of the first image data in the first process and the upper portion of the second image data in the second process to the display memory section. The second selector section outputs the first portion of the display data read out from the display memory section to the latch section in the first process, and the first portion of the read out display data for display of the first image data and the second portion of the read out display data for display of the second image data in the second process. The third selector section outputs the second portion of the display data to the latch section in the first process, and the first portion of the read out display data for display of the first image data and the second portion of the read out display data for display of the second image data in the second process. The latch section latches outputs from the second and third selector sections.

Here, the control driver may further include a data line driving circuit which drives data lines of the display section, based on gradation voltages and the latched data by the latch section.

Also, the display memory section may include a first display memory which stores the first portion of the display data; and a second display memory which stores the second portion of the display data.

In this case, the display memory section may include a plurality of memory cells arranged in a matrix of columns and rows. The first display memory may be formed from odd numbered columns, and the second display memory may be formed from even numbered columns.

In this case, the second selector section may include a plurality of second selectors which are provided for the odd numbered columns; and the third selector section may include a plurality of third selectors which are provided for the even numbered columns. The odd numbered column for one of data bits of the first portion of the display data is desirably provided in neighbor to the even numbered column for a data bit of the second portion corresponding to the data bit of the first portion. The data bit read out from the odd numbered column is desirably connected with the second and third selectors corresponding to the odd numbered column and the even numbered column, and the data bit read out from the even numbered column is desirably connected with the second and third selectors corresponding to the odd numbered column and the even numbered column.

Also, rows of the memory cells of the odd numbered columns are desirably connected with first word lines, and rows of the memory cells of the even numbered columns are desirably connected with second word lines. The display memory section may further include a word line decoder which selects one of the first word lines and one of the second word lines based on one of a write address and a read address.

In this case, the word line decoder may select one of the first word lines and one of the second word lines at a time based on the write address for a write operation of the first image data and based on the read address for a read operation of the first image data in the first process. Also, the word line decoder may select one of the first word lines based on a first write address for a write operation of the upper portion of the first image data and selects one of the second word lines based on a second write address for a write operation of the upper portion of the second image data, and may select one of the first word lines based on a first read address for a read operation of the upper portion of the first image data and selects one of the second word lines based on a second read address for a write operation of the upper portion of the second image data.

In another aspect of the present invention, a display apparatus includes an image drawing unit which outputs an image data of a first image data or of the first image data and a second image data; a gradation voltage generating circuit which generates gradation voltages; a display section which is connected data lines, and a control driver. The first image data has a same pixel size as that of the display section. The control driver includes a display memory section, first to third selector sections and a latch section. The display memory section stores first and second portions of display data. The first and second portions are upper and lower portions of a first image data in a first process, and the first and second portions are the upper portion of the first image data and an upper portion of a second image data in a second process, and the first image data has a same pixel size as that of a display section on which the display data is displayed. The first selector section outputs as the second portion, the lower portion of the first image data in the first process and the upper portion of the second image data in the second process to the display memory section. The second selector section outputs the first portion of the display data read out from the display memory section to the latch section in the first process, and the first portion of the read out display data for display of the first image data and the second portion of the read out display data for display of the second image data in the second process. The third selector section outputs the second portion of the display data to the latch section in the first process, and the first portion of the read out display data for display of the first image data and the second portion of the read out display data for display of the second image data in the second process. The latch section latches outputs from the second and third selector sections.

Here, the control driver may further include a data line driving circuit which drives the data lines of the display section based on gradation voltages and the latched data by the latch section.

Also, the display memory section may include a first display memory which stores the first portion of the display data; and a second display memory which stores the second portion of the display data.

In this case, the display memory section may include a plurality of memory cells arranged in a matrix of columns and rows. The first display memory may be formed from odd numbered columns, and the second display memory may be formed from even numbered columns.

In this case, the second selector section may include a plurality of second selectors which are provided for the odd numbered columns; and the third selector section may include a plurality of third selectors which are provided for the even numbered columns. The odd numbered column for one of data bits of the first portion of the display data is desirably provided in neighbor to the even numbered column for a data bit of the second portion corresponding to the data bit of the first portion. The data bit read out from the odd numbered column is desirably connected with the second and third selectors corresponding to the odd numbered column and the even numbered column, and the data bit read out from the even numbered column is desirably connected with the second and third selectors corresponding to the odd numbered column and the even numbered column.

Also, rows of the memory cells of the odd numbered columns are desirably connected with first word lines, and rows of the memory cells of the even numbered columns are desirably connected with second word lines. The display memory section may further include a word line decoder which selects one of the first word lines and one of the second word lines based on one of a write address and a read address.

In this case, the word line decoder may select one of the first word lines and one of the second word lines at a time based on the write address for a write operation of the first image data and based on the read address for a read operation of the first image data in the first process. Also, the word line decoder may select one of the first word lines based on a first write address for a write operation of the upper portion of the first image data and selects one of the second word lines based on a second write address for a write operation of the upper portion of the second image data, and may select one of the first word lines based on a first read address for a read operation of the upper portion of the first image data and selects one of the second word lines based on a second read address for a write operation of the upper portion of the second image data.

In another aspect of the present invention, a mobile terminal includes an input unit used to supply an image data and a scroll instruction; and a display apparatus. The display apparatus includes an image drawing unit which outputs an image data of a first image data or of the first image data and a second image data; a gradation voltage generating circuit which generates gradation voltages; a display section which is connected data lines, and a control driver. The first image data has a same pixel size as that of the display section. The control driver includes a display memory section, first to third selector sections and a latch section. The display memory section stores first and second portions of display data. The first and second portions are upper and lower portions of a first image data in a first process, and the first and second portions are the upper portion of the first image data and an upper portion of a second image data in a second process, and the first image data has a same pixel size as that of a display section on which the display data is displayed. The first selector section outputs as the second portion, the lower portion of the first image data in the first process and the upper portion of the second image data in the second process to the display memory section. The second selector section outputs the first portion of the display data read out from the display memory section to the latch section in the first process, and the first portion of the read out display data for display of the first image data and the second portion of the read out display data for display of the second image data in the second process. The third selector section outputs the second portion of the display data to the latch section in the first process, and the first portion of the read out display data for display of the first image data and the second portion of the read out display data for display of the second image data in the second process. The latch section latches outputs from the second and third selector sections.

Here, the control driver may further include a data line driving circuit which drives the data lines of the display section based on gradation voltages and the latched data by the latch section.

Also, the display memory section may include a first display memory which stores the first portion of the display data; and a second display memory which stores the second portion of the display data.

In this case, the display memory section may include a plurality of memory cells arranged in a matrix of columns and rows. The first display memory may be formed from odd numbered columns, and the second display memory may be formed from even numbered columns.

In this case, the second selector section may include a plurality of second selectors which are provided for the odd numbered columns; and the third selector section may include a plurality of third selectors which are provided for the even numbered columns. The odd numbered column for one of data bits of the first portion of the display data is desirably provided in neighbor to the even numbered column for a data bit of the second portion corresponding to the data bit of the first portion. The data bit read out from the odd numbered column is desirably connected with the second and third selectors corresponding to the odd numbered column and the even numbered column, and the data bit read out from the even numbered column is desirably connected with the second and third selectors corresponding to the odd numbered column and the even numbered column.

Also, rows of the memory cells of the odd numbered columns are desirably connected with first word lines, and rows of the memory cells of the even numbered columns are desirably connected with second word lines. The display memory section may further include a word line decoder which selects one of the first word lines and one of the second word lines based on one of a write address and a read address.

In this case, the word line decoder may select one of the first word lines and one of the second word lines at a time based on the write address for a write operation of the first image data and based on the read address for a read operation of the first image data in the first process. Also, the word line decoder may select one of the first word lines based on a first write address for a write operation of the upper portion of the first image data and selects one of the second word lines based on a second write address for a write operation of the upper portion of the second image data, and may select one of the first word lines based on a first read address for a read operation of the upper portion of the first image data and selects one of the second word lines based on a second read address for a write operation of the upper portion of the second image data.

In another aspect of the present invention, a control driver for displaying image data on a display section, includes a plurality of memory cells arranged in a matrix of columns and rows, wherein a first display memory is formed from odd numbered columns, and a second display memory is formed from even numbered columns, a plurality of second selectors which are provided for the odd numbered columns; and a plurality of third selectors which are provided for the even numbered columns. An output from the odd numbered column is connected with the second and third selectors corresponding to the odd numbered column and the even numbered column provided in neighbor to the odd numbered column. Also, an output from the even numbered column is connected with the second and third selectors corresponding to the odd numbered column and the even numbered column.

In another aspect of the present invention, a method of displaying an image data on a display section, may be achieved by determining whether a pixel size of the image data is larger than a pixel size of the display section; by writing upper and lower portions of a first image data in first and second display memories when the pixel size of the image data is not larger than that of the display section and the image data contains only the first image data; by reading out the upper and lower portions of the first image data from the first and second display memories such that the image data is displayed on the display section in a full gradation, when the pixel size of the image data is not larger than that of the display section and the image data contains only the first image data; by writing the upper portion of the first image data in the first display memory when the pixel size of the image data is larger than that of the display section and the image data contains the first image data and a second image data; by writing an upper portion of the second image data in the second display memory after the write of the upper portion of the first image data; by reading out the upper portion of the first image data from the first display memory such that the first image data is displayed on the display section in a half gradation, when the pixel size of the image data is not larger than that of the display section and the image data contains the first image data and the second image data; and by reading out the upper portion of the first image data from the first display memory such that the first and second image data are displayed on the display section in the half gradation, in response to a scroll instruction after the read of the upper portion of the first image data.

BRIEF DESCRIPTION OF THE DRAWINGS

FIG. 7 is a diagram showing a relation between a memory division signal SELECT1, a memory read select signal SELECT2, an output of a first selector section, an output of a second selector section and an output of the third selector section in the control driver of the present invention;

DESCRIPTION OF THE PREFERRED EMBODIMENTS

Hereinafter, a control driver of the present invention and a display apparatus to which the control driver is applied will be described below with reference to the attached drawings. This patent application is related to U.S. patent application Ser. No. 10/684,389. The disclosure of the related US patent application is incorporated herein by reference.

Figure 1:
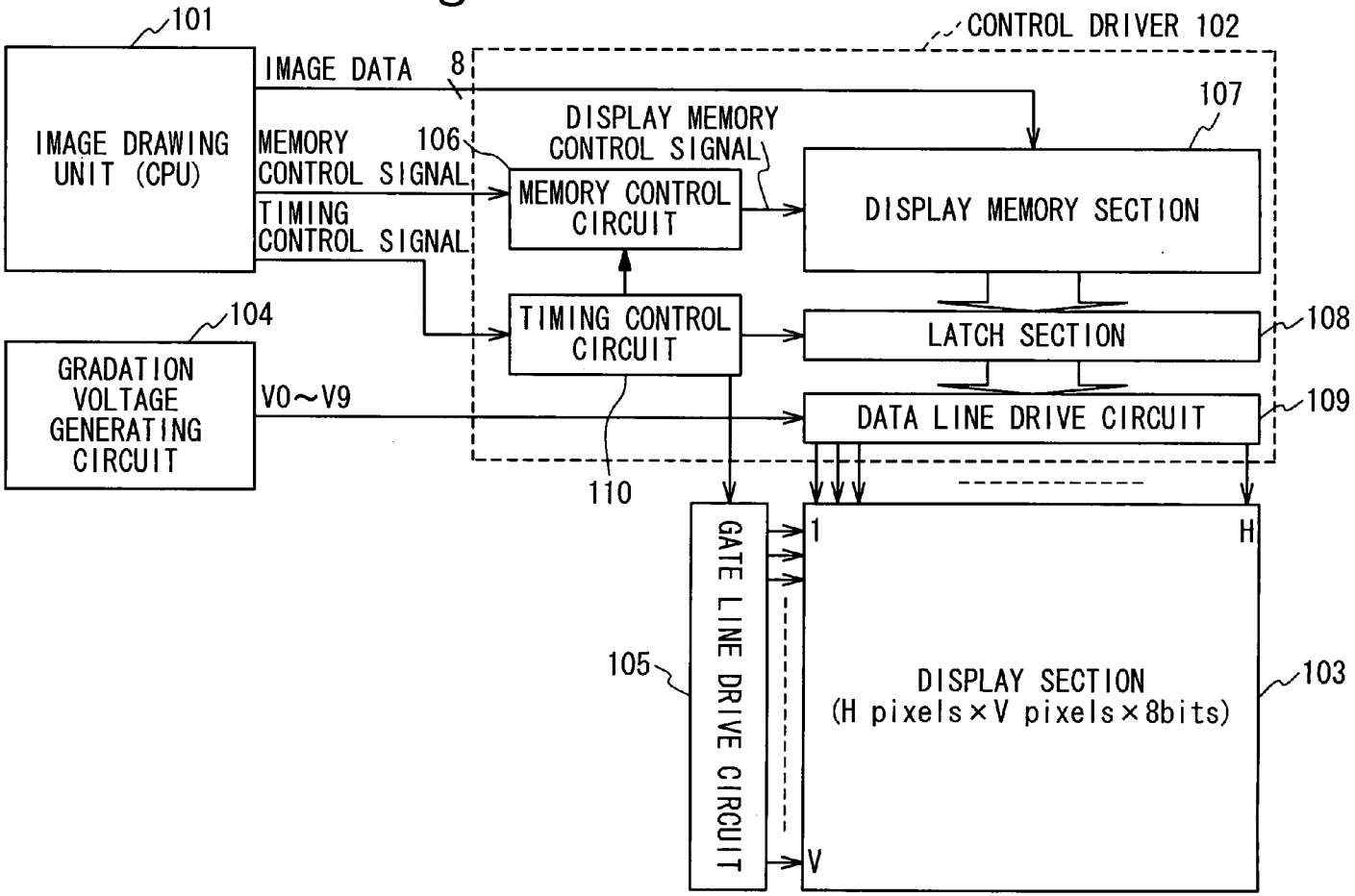
Fig. 1 PRIOR ART
FIG. 1 is a block diagram showing the structure of a mobile terminal to which a conventional control driver is applied.
Figure 2:
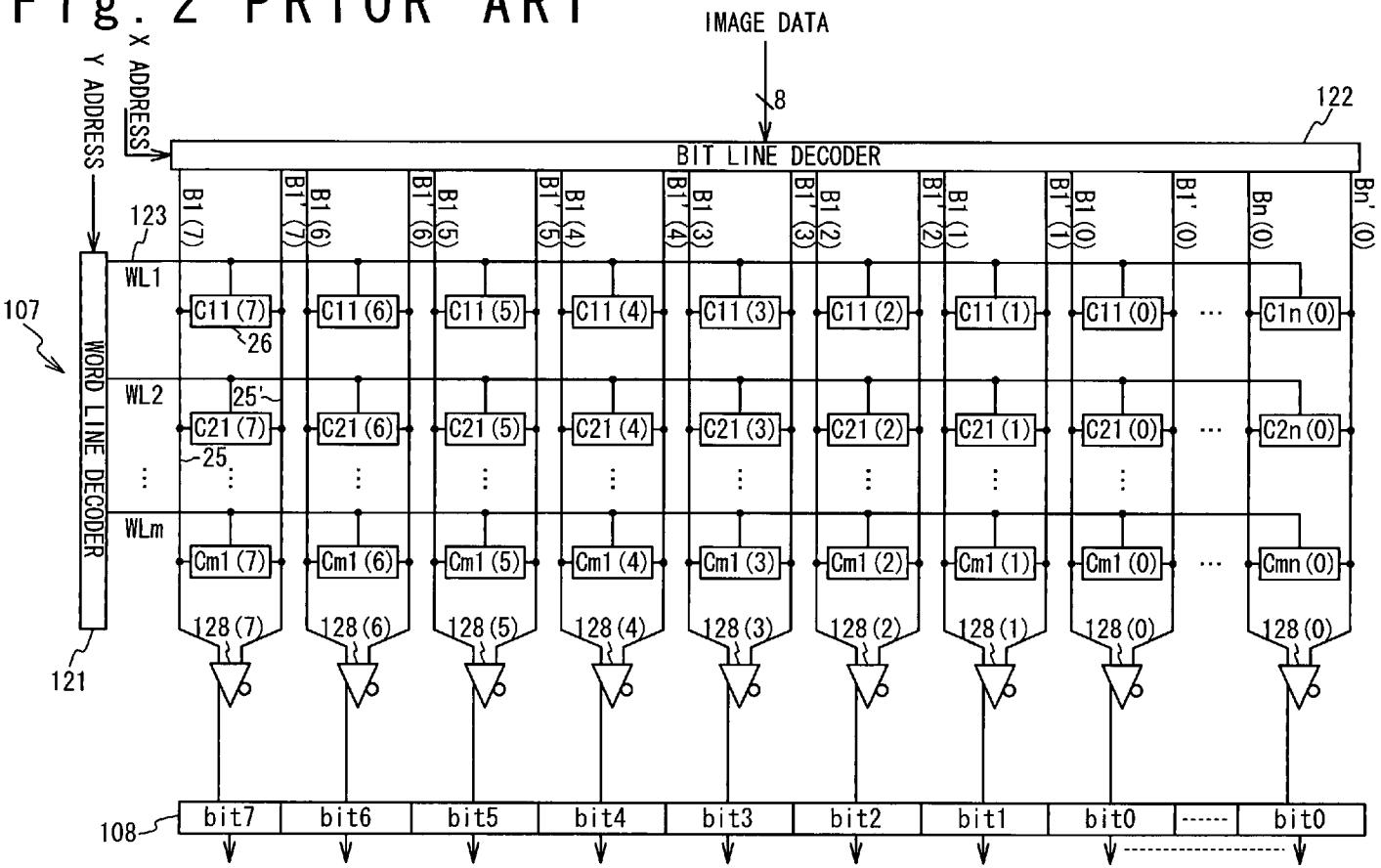
Fig. 2 PRIOR ART
FIG. 2 is a block diagram showing the structure of a display memory section and a latch section in the conventional control driver.
Figure 3:
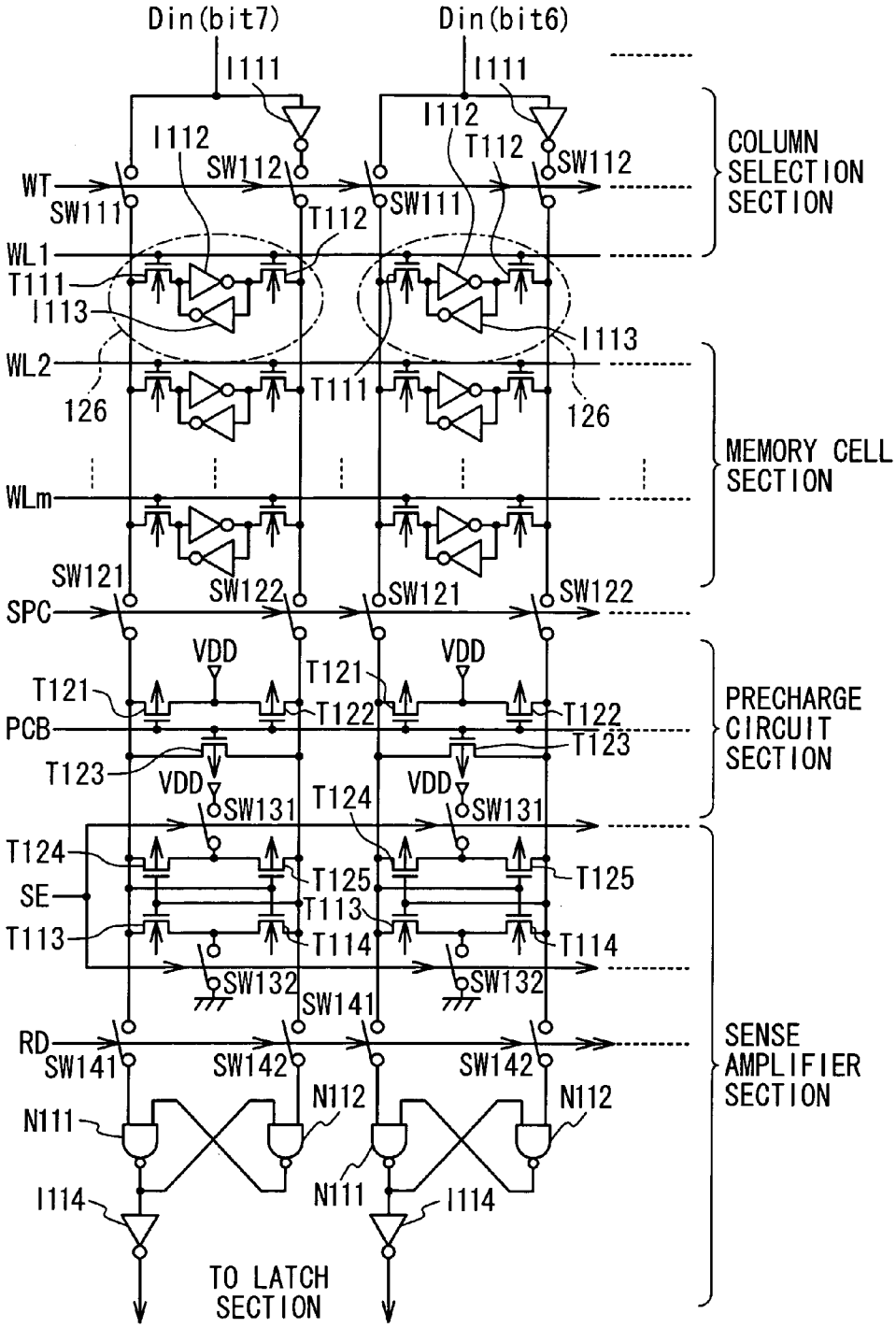
Fig. 3 PRIOR ART
FIG. 3 is a circuit diagram showing the structure of a part of the display memory section of the conventional control driver.
Figures 4A, 4B, 4C, 4D, 4E, 4F, 4G:
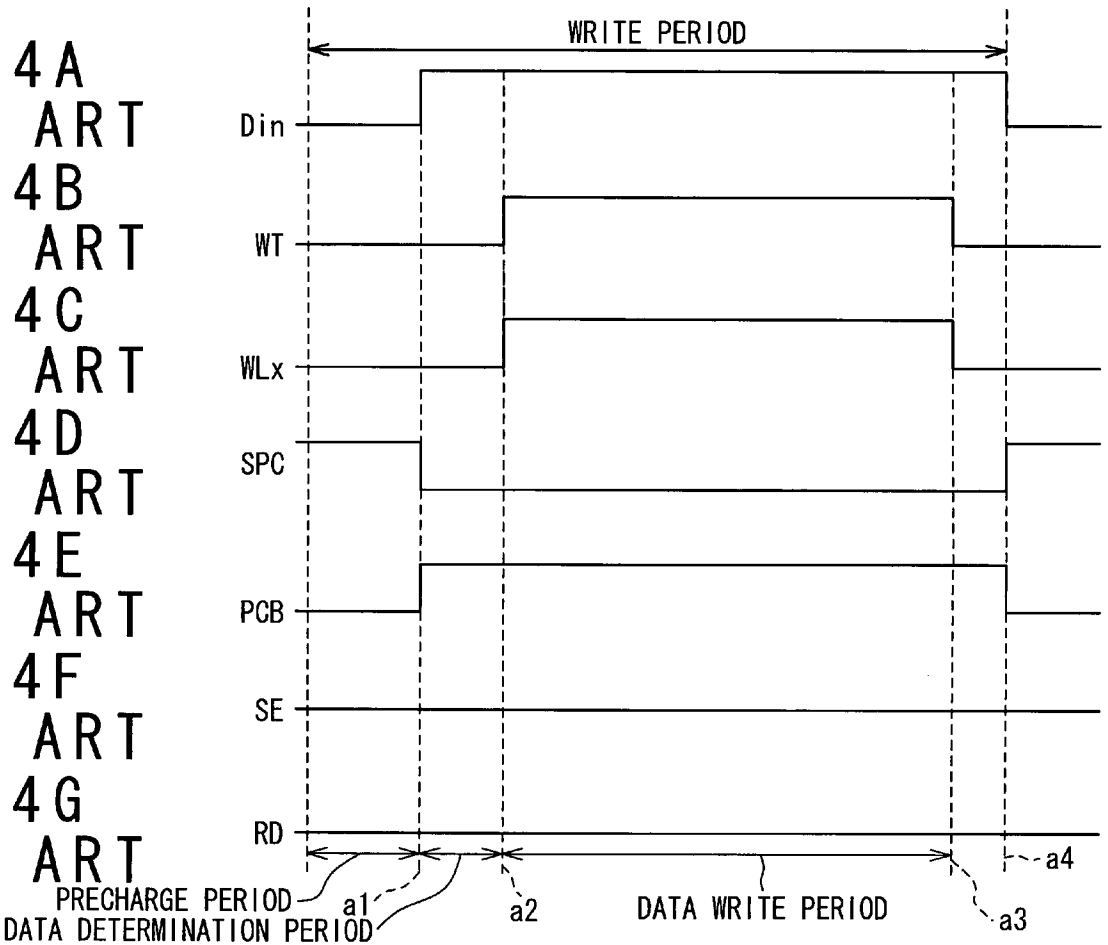
Fig. 4A PRIOR ART
Fig. 4B PRIOR ART
Fig. 4C PRIOR ART
Fig. 4D PRIOR ART
Fig. 4E PRIOR ART
Fig. 4F PRIOR ART
Fig. 4G PRIOR ART
FIGS. 4A to 4G are timing charts showing a write operation of the conventional control driver.
Figures 5A, 5B, 5C, 5D, 5E, 5F, 5G:
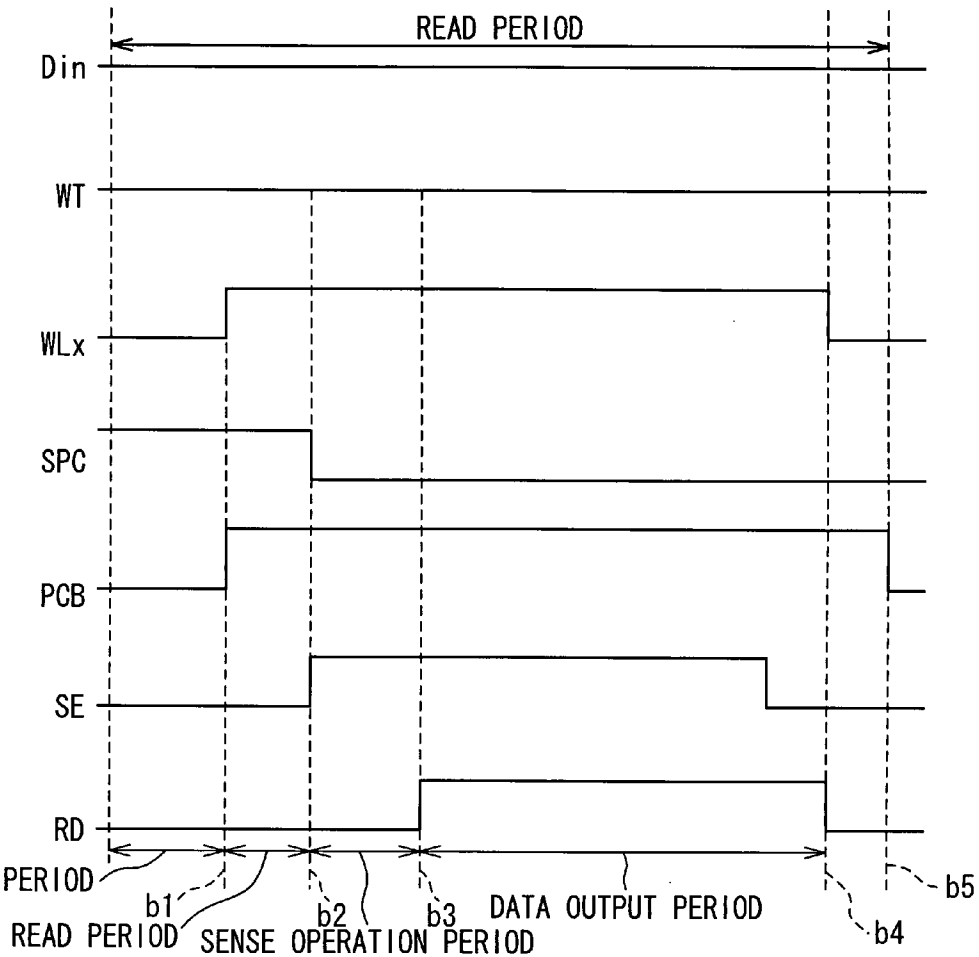
Fig. 5A PRIOR ART
Fig. 5B PRIOR ART
Fig. 5C PRIOR ART
Fig. 5D PRIOR ART
Fig. 5E PRIOR ART
Fig. 5F PRIOR ART
Fig. 5G PRIOR ART
FIGS. 5A to 5G are timing charts showing a read operation of the conventional control driver.
Figure 6:
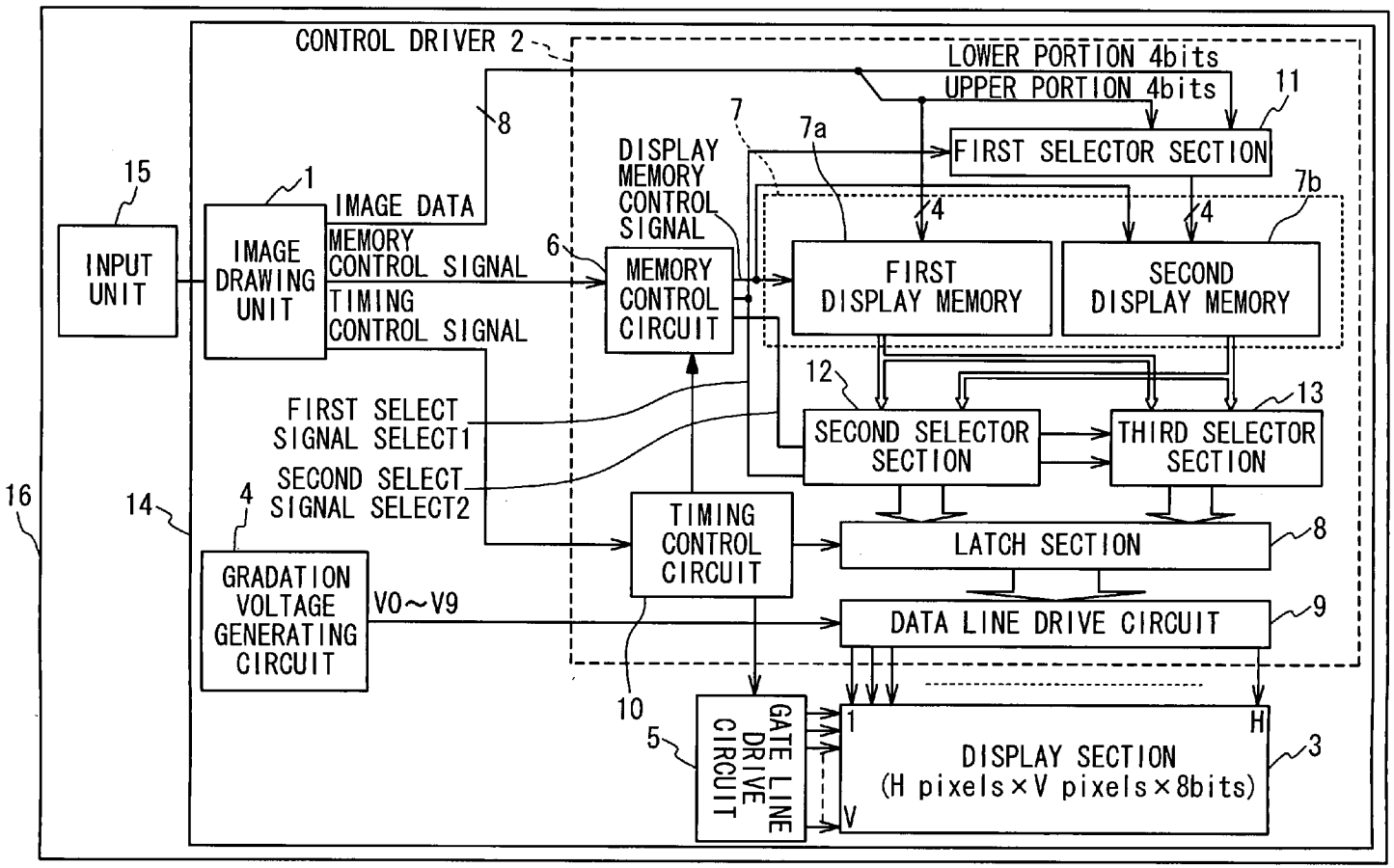
FIG. 6 is a block diagram showing the structure of a mobile terminal to which a control driver of the present invention is applied.

FIG. 6 is a block diagram schematically showing the structure of a mobile terminal to which the control driver of the present invention is applied. As shown in FIG. 6, the mobile terminal 16 contains a display unit 14 and an input unit 15 for the user to operate. A portable phone and a PDA (Personal Digital Assistant) in which the low consumption power is required are exemplified as the mobile terminal 16. The input unit 15 is connected with the display unit 14. The display unit 14 is not limited to that of the mobile terminal 16 and may be an optional type of display unit.

The display unit 14 contains an image drawing unit 1, a control driver 2, a display section 3, a gradation voltage generating circuit 4 and a gate line drive circuit 5. A CPU is exemplified as the image drawing unit 1. The control driver 2 contains a latch section (not shown), a memory control circuit 6, a display memory section 7, a latch section 8, a data line drive circuit 9, a timing control circuit 10 and first to third selector sections 11 to 13. The display memory section 7 contains a first display memory 7*a* and a second display memory 7*b*. A summation of the pixel size of the first display memory 7*a* and the pixel size of the second display memory 7*b* is equal to the pixel size of the display section 3. Image data can be displayed in spite of the size of the image data, by dividing the display memory section 7 into a plurality of memories.

The image drawing unit 1 outputs a timing control signal to the timing control circuit 10. The timing control circuit 10 generates a timing signal in response to the timing control signal and supplies it as a clock signal to the memory control circuit 6, the latch section 8 and the gate line drive circuit 5. The memory control circuit 6, the latch section 8 and the gate line drive circuit 5 operate in synchronism with the timing signal.

The image drawing unit 1 outputs a memory control signal containing a size of the image data, a write/read mode, and addresses of the display memory section 7 to the memory control circuit 6. The memory control circuit 6 generates a display memory control signal containing a write/read signal and addresses in response to the memory control signal and the timing signal and outputs it to the first and second display memories 7*a* and 7*b*. Also, in response to the memory control signal, the memory control circuit 6 generates a first select signal SELECT1 to supply to the first to third selector sections 11 to 13, and a second select signal SELECT2 to supply to the second and third selector sections 12 and 13.

The image drawing unit 1 transfers image data to the control driver 2. The image data is of 8 bits and contains 4 upper bits and 4 lower bits of each of pixels. Hereinafter, the 4 upper bits of the pixels are referred to as an upper portion of the image data, and the 4 lower bits of the pixels are referred to as a lower portion of the image data.

The first selector section 11 selects one of the lower portion of first image data and the upper portion of second image data in response to the first select signal SELECT1. Here, the first image data is image data having the same pixel size as that of the display section 3 and the second image data is image data subsequent to the first image data. The lower portion of the first image data and the selected portion are latched by the latch section (not shown).

The first display memory 7*a* stores the upper portion of the first image data in response to the display memory control signal containing the write signal and a first write start address. Also, the second display memory 7*b* stores the selected portion in response to the display memory control signal containing the write signal and a second write start address.

The lower portion of the first image data as a first portion stored in the first display memory 7*a* is read out in response to the display memory control signal containing the read signal and a first read start address and is supplied to the second and third selector sections 12 and 13. The portion selected by the first selector section 11 and stored in the second display memory 7*b* as a second portion is read out in response to the display memory control signal containing the read signal and a second read start address, and is supplied to the second and third selector sections 12 and 13.

The second selector section 12 selects one of the first portion and the second portion in response to the first and second select signals SELECT1 and SELECT2 and the timing signal and supplies to the latch section 8. Also, the third selector section 13 selects one of the first portion and the second portion in response to the first and second select signals SELECT1 and SELECT2 and the timing signal and supplies to the latch section 8.

The latch section 8 latches the portion selected by the second selector section 12 and the portion selected by the third selector section 13 in response to the timing signal such that display data corresponding to the pixels of the display section 3 for one gate line can be formed from these portions. The display data for the gate line is outputted to the data line drive circuit 9.

The data line drive circuit 9 drives the data lines based on the gradation voltages from the gradation voltage generating circuit 4 and the data bits of each pixel of the display data for one gate line. Also, the gate line drive circuit 5 sequentially drives the gate lines in response to the timing signal. Thus, the display data is fully displayed on the display section 3.

Next, operation of the first to third selector sections 11 to 13 will be described with reference to FIG. 7.

In the control driver of the present invention, there are first to fourth modes.

In the first mode in which the first and second select signals SELECT1 and SELECT2 are both in the low (L) level. This first mode is applied to the write operation of a first process, in which the first image data is written in the first and second display memories 7*a* and 7*b*. Therefore, the lower portion of the first image data is selected by the first selector section 11 in response to the first select signal SELECT1, and stored in the second display memory 7*b*.

Also, in the second mode in which the first select signal SELECT1 is in the low (L) level and the second select signal SELECT2 is in the high (H) level. This second mode is applied to the write and read operations of the first process. The upper portion of the first image data is stored in the first display memory 7*a*. The lower portion of the first image data is selected by the first selector section 11 in response to the first select signal SELECT 1, and stored in the second display memory 7*b*. The second selector section 12 selects the upper portion of the first image data read out from the first display memory 7*a* in response to the first and second select signals SELECT 1 and SELECT2, and the third selector section 13 selects the lower portion of the first image data read out from the second display memory 7*b* in response to the first and second select signals SELECT 1 and SELECT2.

Also, in the third mode in which the first select signal SELECT1 is in the high (H) level and the second select signal SELECT2 is in the low (H) level. This third mode is applied to the write and read operations of a second process, in which the first image data and the second image data are written in the first and second display memories 7*a* and 7*b*, respectively. The upper portion of the first image data is stored in the first display memory 7*a*. The upper portion of the second image data is selected by the first selector section 11 in response to the first select signal SELECT 1, and stored in the second display memory 7*b*. Each of the second selector section 12 and the third selector section 13 selects the upper portion of the first image data read out from the first display memory 7*a* in response to the first and second select signals SELECT 1 and SELECT2.

Also, in the fourth mode in which the first select signal SELECT1 is in the high level and the second select signal SELECT2 is in the high level. This fourth mode is applied to the write and read operations of the second process. The upper portion of the first image data is stored in the first display memory 7*a*. The upper portion of the second image data is selected by the first selector section 11 in response to the first select signal SELECT 1, and stored in the second display memory 7*b*. Each of the second selector section 12 and the third selector section 13 selects the upper portion of the second image data read out from the second display memory 7*b* in response to the first and second select signals SELECT 1 and SELECT2.

Next, the operation of the display unit 14 will be described.

Figure 8:
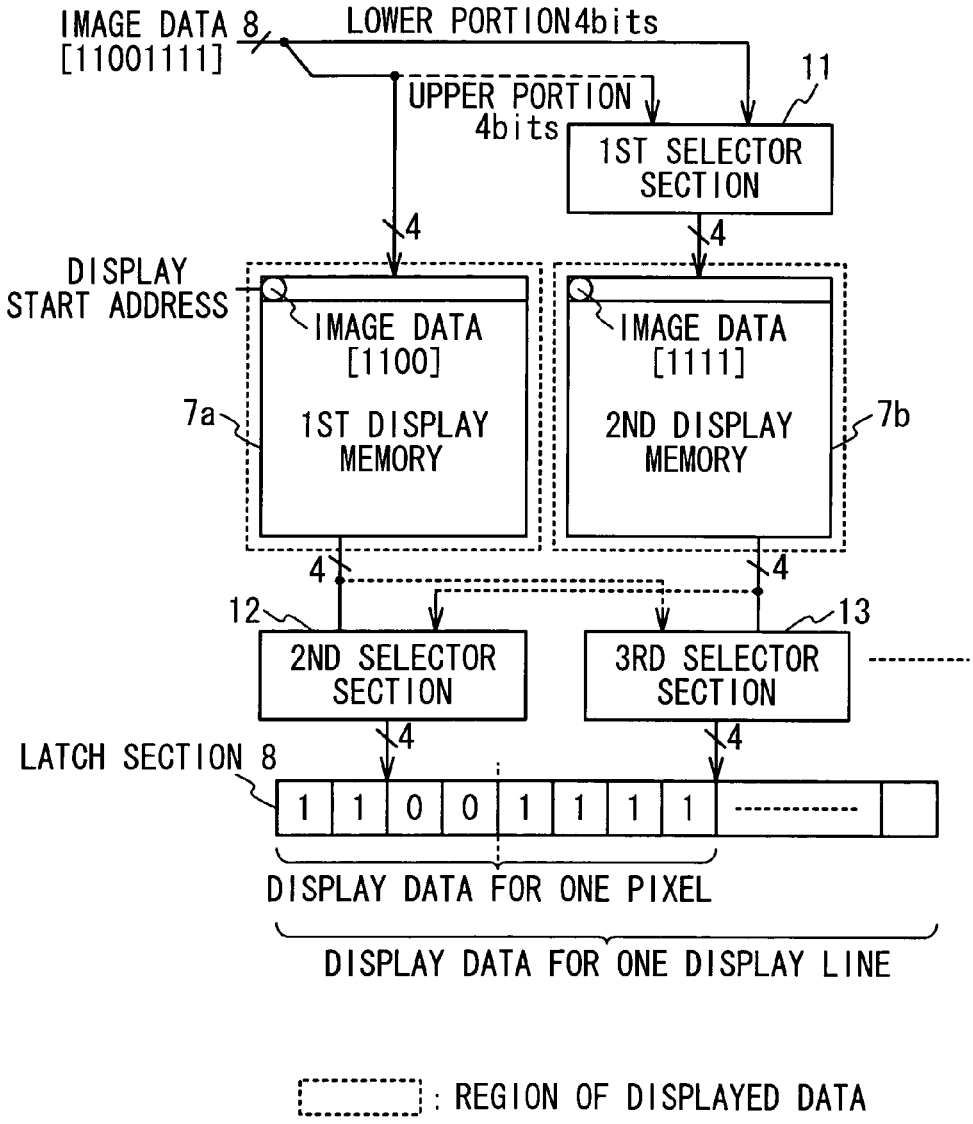
FIG. 8 is a schematic diagram showing a first process in which a scroll instruction is not needed, in the control driver of the present invention.

FIG. 8 is a schematic diagram showing the second mode in the first process, in which the first image data has the same size as that of the display section 3, in the control driver of the present invention. In the first process, it is supposed that a first pixel of the first image data corresponding to a first write start address has the data bits of "11001111". Therefore, the upper portion of the first pixel is "1100" and the lower portion of the first pixel is "1111".

Referring to FIG. 8, in the write operation of the first process, the image drawing unit 1 transfers the upper portion of the image data and the lower portion of the image data to the controller driver 2 in synchronism with the timing signal. The memory control circuit 6 outputs the first select signal SELECT1 in the low level to the first selector 11 in response to the timing signal. Also, the memory control circuit 6 outputs the display memory control signal containing the write signal and the first write start address to the first display memory 7*a* and outputs the display memory control signal containing the write signal and the second write start address to the second display memory 7*b*. The first selector section 11 outputs the lower portion of the first image data from the image drawing unit 1 to the second display memory 7*b* in response to the first select signal SELECT1 in the low level. At this time, the upper portion of the image data is stored in the first display memory 7*a* in response to the display memory control signal. Also, the lower portion of the image data is stored in the second display memory 7*b* in response to the display memory control signal.

In the read operation of the first process, the memory control circuit 6 outputs the display memory control signal containing the read signal and the first read start address to the first display memory 7*a* in response to the timing signal and the memory control signal. Also, the memory control circuit 6 outputs the display memory control signal containing the read signal and the second read start address to the second display memory 7*b* in response to the timing signal and the memory control signal. The memory control circuit 6 outputs the first select signal SELECT1 in the low level and the second select signal SELECT2 in the high level to the second selector 12 and the third selector 13 in response to the timing signal and the memory control signal. At this time, the upper portion of the first image data corresponding to a one gate line is read out from the first display memory 7*a* in response to the display memory control signal. Also, the lower portion of the first image data corresponding to the gate line is read out from the second display memory 7*b* in response to the display memory control signal.

The second selector section 12 outputs the upper portion of the first image data corresponding to the gate line read out from the first display memory 7*a* to the latch section 8 as the upper portion of the display data in response to the first select signal SELECT1 in the low level and the second select signal SELECT2 in the high level. The third selector section 13 outputs the lower portion of the display data read out from the second display memory 7*b* to the latch section 8 in response to the first select signal SELECT1 in the low level and the second select signal SELECT2 in the high level. The latch section 8 latches the upper portion and low portion of the display data for the gate line read out from the first display memory 7*a* and the second display memory 7*b*. The latch section 8 outputs the display data for the gate line to the data line drive circuit 9 in response to the timing signal. The data line drive circuit 9 receives the display data from the latch section 8, and drives the data lines of the display section 3 such that the display is carried out in the full gradation based on the gradation voltages from the gradation voltage generating circuit 4 and the display data.

Next, a case where the image data composed of the first image data and the second image data is displayed will be described with reference to FIGS. 9A and 9B.

In this case, it could be considered that the upper portion of the first or second image data is used as it is, and "0000" is allocated to the lower portion of the display data. However, when "0000" is allocated to the lower portion, the display data possibly takes a value in a range from "00000000" to "11110000". Also, when "1111" is allocated to the lower portion, the display data possibly takes a value in a range from "100001111" to "11111111". In the former case, the display data can not take "11111111" in which all bits are 1, and in the latter case, the display data can not be take "00000000" which all bits are 0. For this reason, the full white or full black can not be displayed on the display section 3. Therefore, in the present invention, when the image data is composed of the first image data and the second image data, the same data as the upper portion of the display data is allocated to the lower portion of the display data, so that the display data can be take a value in a range from "00000000" to "11111111". Therefore, in the present invention, the full white or the full black can be displayed on the display section 3.

Figure 9A:
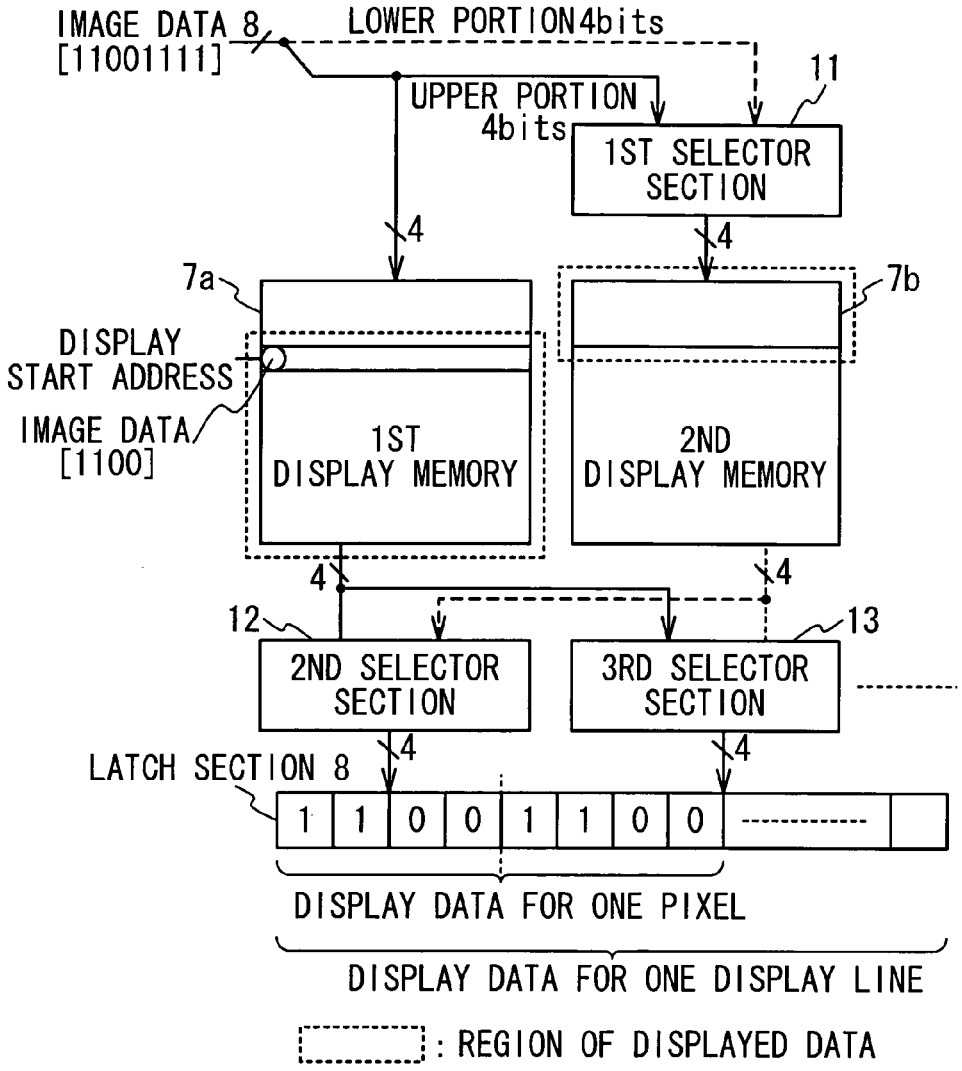
FIG. 9A is a schematic diagram showing a second process in which the scroll instruction is needed and a first screen is displayed, in the control driver of the present invention.
Figure 9B:
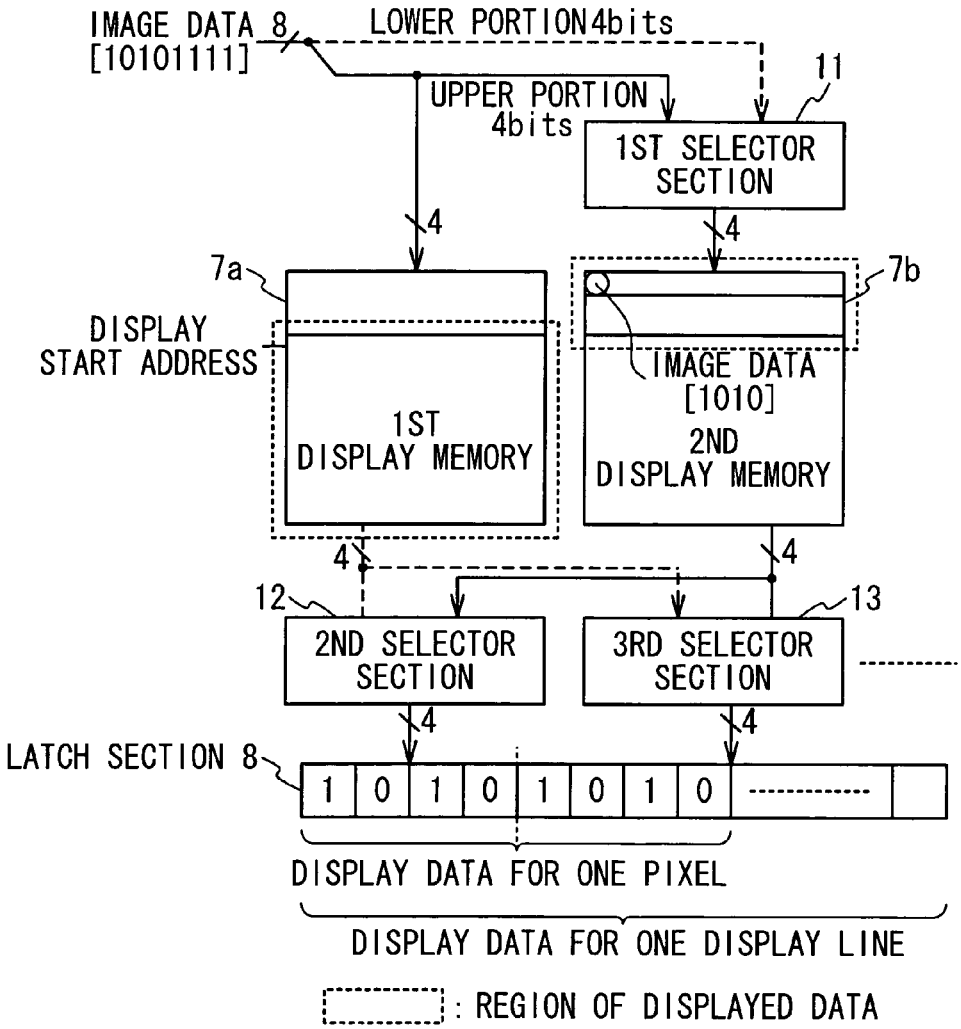
FIG. 9B is a schematic diagram showing a third process in which the scroll instruction is needed and a second screen is displayed, in the control driver of the present invention.

Referring to FIG. 9A, in the second process, in which the image data has the larger size as that of the display section 3, it is supposed that the first pixel of the first image data corresponding to a first write start address has the data bits of "11001111". Therefore, the upper portion of the first pixel is "1100" and the lower portion of the first pixel is "1111". Also, referring to FIG. 9B, it is supposed that the data bits of the pixel of the second image data corresponding to the display start address are "10101111". Therefore, the upper portion of the first pixel is "1010" and the lower portion of the first pixel is "1111".

In the write operation of the second process, the image drawing unit 1 transfers the first image data and the second image data to the controller driver 2 in order in synchronism with the timing signal. The memory control circuit 6 outputs the first select signal SELECT1 in the high level to the first selector section 11 in response to the timing signal and the memory control signal, and outputs the display memory control signal containing the write signal and the first write start address to the first display memory 7*a* and outputs the display memory control signal containing the write signal and the second write start address to the second display memory 7*b*. The upper portion of the first image data is stored in the first display memory 7*a* in response to the display memory control signal, as shown in FIG. 9A. However, the first selector section 11 does not select the lower portion of the first image data. When the second image data is transferred, the upper portion of the second image data is not stored in the first display memory 7*a*, and the first selector section 11 selects and outputs the upper portion of the second image data from the image drawing unit 1 to the second display memory 7*b* in response to the first select signal SELECT1 in the high level, as shown in FIG. 9B. Thus, the upper portion of the second image data is stored in the second display memory 7*b* in response to the display memory control signal.

In the read operation of the second process, the memory control circuit 6 outputs the display memory control signal containing the read signal and the first read start address to the first display memory 7*a*, and outputs the first select signal SELECT1 in the high level and the second select signal SELECT2 in the low level to the second selector 12 and the third selector 13, in response to the timing signal and the memory control signal. At this time, the upper portion of the first image data for a gate line as an upper portion of display data for the gate line is read out from the first display memory 7*a* in response to the display memory control signal. The second selector section 12 outputs the upper portion of display data for the gate line to the latch section 8 in response to the first select signal SELECT1 in the high level and the second select signal SELECT2 in the low level. The third selector section 13 outputs the upper portion of the second image data for the gate line read out from the first display memory 7*a* to the latch section 8 as the lower portion of the display data for the gate line in response to the first select signal SELECT1 in the high level and the second select signal SELECT2 in the low level, as shown in FIG. 9A. The latch section 8 latches the upper portion and lower portion of the display data for the gate line in response to the timing signal. At this time, the latch section 8 latches the data bits of "11001100 . . . ". The latch section 8 outputs the display data to the data line drive circuit 9 in response to the timing signal. The data line drive circuit 9 receives the display data from the latch section 8, and drives the data lines of the display section 3 such that a display is carried out in the half gradation based on the gradation voltages from the gradation voltage generating circuit 4 and the display data.

Next, it is supposed that the user operates the input unit 15 to issue a scroll instruction. In this case, the operation for the display of the first image data is the same as described above. However, an operation for the display of the second image data stored in the second display memory 7*b* is different from the above operation.

That is, when the second image data is displayed on the display section 3, the memory control circuit 6 outputs the display memory control signal containing the read signal and the second read start address to the second display memory 7*b* in response to the timing signal and the memory control signal, and outputs the first select signal SELECT1 in the high level and the second select signal SELECT2 in the high level to the second selector section 12 and the third selector section 13. The upper portion of the second image data for a gate line is read out from the second display memory 7*b* in response to the display memory control signal. The second selector section 12 outputs the upper portion of the second image data for the gate line read out from the second display memory 7*b* to the latch section 8 as the upper portion of the display data for the gate line in response to the first select signal SELECT1 on the high level and the second select signal SELECT2 in the high level. The third selector section 13 outputs the upper portion of the second image data for the gate line read out from the second display memory 7*b* to the latch section 8 as the lower portion of the display data for the gate line in response to the first select signal SELECT1 in the high level and the second select signal SELECT2 in the high level. The latch section 8 latches the upper portion and the lower portion of the display data for the gate line in response to the timing signal. The latch section 8 outputs the display data to the data line drive circuit 9 in response to the timing signal. The data line drive circuit 9 receives the display data from the latch section 8 and drives the data lines of the display section 3 such that a display is carried in a half gradation based on the gradation voltages from the gradation voltage generating circuit 4 and the display data.

As mentioned above, in the conventional mobile terminal, when the size of the image data is larger than the size of the screen of the display section and has the first image data and the second image data, the image drawing unit 101 transfers the first image data, the controller driver 102 stores the first image data in the display memory section 107, and the first image data stored in the display memory section 107 is displayed on the display section 103. When the display is changed in response to the scroll instruction from the user, the image drawing unit 101 transfers the second image data, the controller driver 102 stores the second image data in the display memory section 107, and the second image data stored in the display memory section 107 is displayed on the display section 103. Thus, in the conventional mobile terminal, when image data is transferred and stored in the display memory section 107 every time the scroll instruction is carried out, the consumption power for the transfer has become large.

On the other hand, according to the controller driver 2 of the present invention, the image data can be displayed on the display section 3 without increasing the consumption power. In the mobile terminal 16, when the size of the image data is larger than the size of the screen of the display section and has the first image data and the second image data, the image drawing unit 1 transfers the first image data and the second image data, the controller driver 2 stores the first image data in the first display memory 7*a*, and stores the second image data in the second display memory 7*b*, and the first image data stored in the first display memory 7*a* is displayed on the display section 3. When the display is changed in response to the scroll instruction from the user, the controller driver 2 displays the second image data stored in the second display memory 7*b* on the display section 3. In this way, the mobile terminal 16 of the present invention carries out the transfer of the image data only once.

Also, according to the controller driver 2 of the present invention, because the memory capacity of the display memory section 7 is the same as the memory capacity of the conventional display memory section 107, the image data can be displayed on the display section 3 without increasing the memory capacity of the display memory 7.

Also, according to the controller driver 2 of the present invention, the mobile terminal 16 of a small size can be realized, because it is not necessary to use a large size of power supply for the reason of increase of the consumption power and to increase the memory capacity of the display memory section 7.

In the controller driver 2 of the present invention, when first display memory 7*a* is merely connected with the latch section 8 through the second selector section 12 and the third selector section 13 and the second display memory 7*b* is connected with the latch section 8 through the second selector section 12 and the third selector section 13, a problem is caused that the wiring line intersections increase. If the wiring line intersections increase, the chip size increases, and the load capacity at the wiring line intersections increases and the consumption power increases. Therefore, any idea is needed for the structure of the display memory section 7, the selector sections 11 to 13 and the latch section 8 to decrease the wiring line intersections so that the chip size does not increase and to prevent increase of the consumption power.

Next, the structure in which the wiring line intersections are decreased will be described with reference to FIG. 13.

Figure 13:
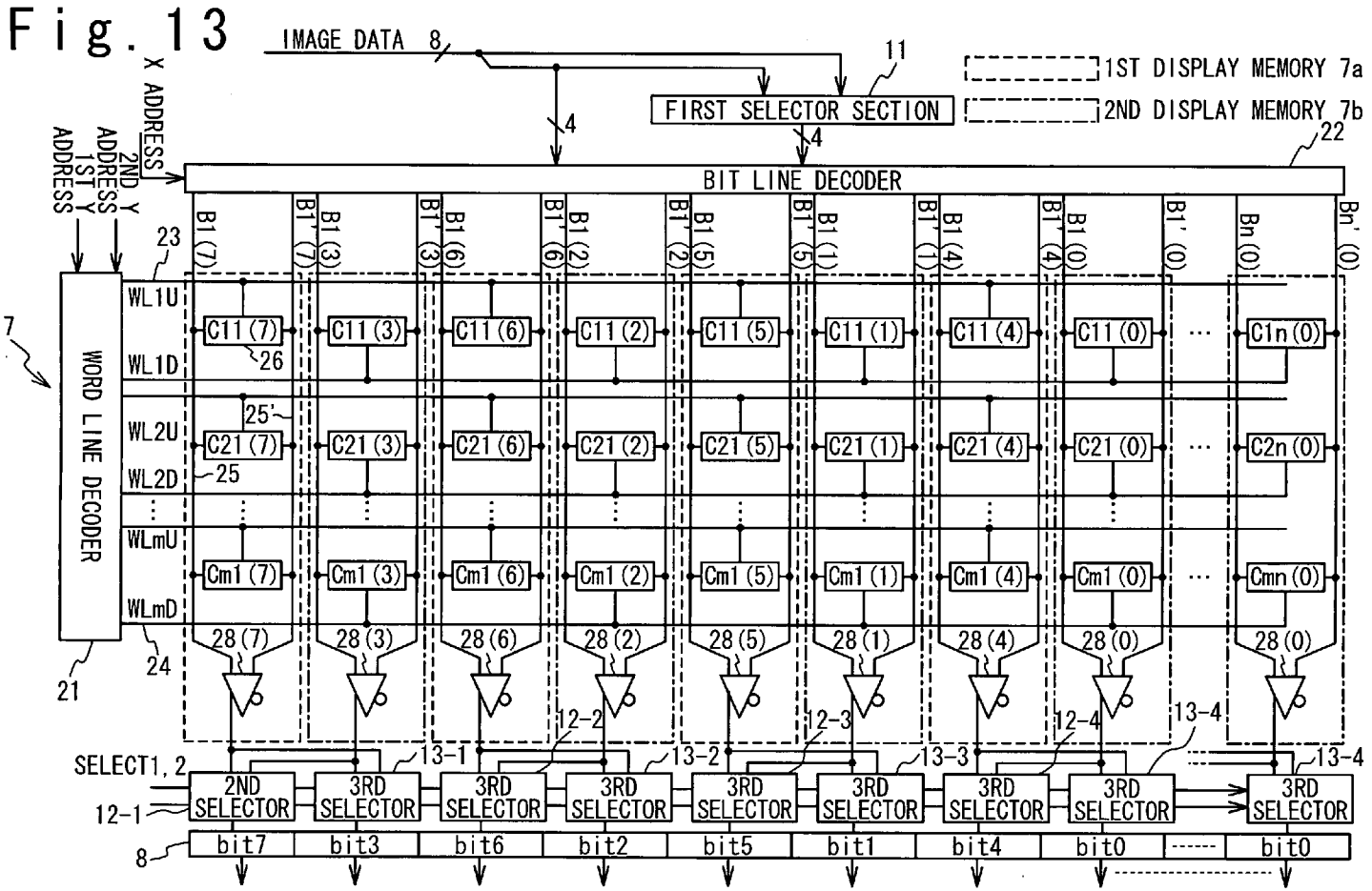
FIG. 13 is a flow chart showing the third process of the mobile terminal to which the control driver of the present invention is applied.

FIG. 13 is a schematic diagram showing the structure of the display memory section 7, the second selector section 12, the third selector section 13 and the latch section 8 in the controller driver of the present invention. The display memory section 7 contains a word line decoder 21 as a column decoder, a bit line decoder 22 as a row decoder and memory cells in a matrix of m×n×8. First word lines WLiU 23 and second word lines WLiD 24 are connected with the word line decoder 21. First bit lines Bj(k) 25 and second bit line Bj'(k) 25 are connected with the bit line decoder 22.

The word line decoder 21 decodes the first Y address and the second Y address of the first write or read start address and the second write or read start address independently, and selects and drives one of each of the first word lines and the second word lines. Also, the bit line decoder 22 decodes the first X address and the second X address of the first write or read start address and the second write or read start address independently, and selects and drives ones of the pairs of bit lines for each of the first and second display memories 7*a* and 7*b*.

The display memory has n×8 columns of the memory cells, and the memory cells 26 of the odd numbered columns are connected with the first word lines WLiU 23 and the memory cells 27 of the even numbered columns are connected with the second word lines WLiD 24. The memory cells 26 of the odd numbered columns constitute the first display memory 7*a*, and the memory cells 26 of the even numbered columns constitute the second display memory 7*b*. The memory cells of every four of the odd numbered columns are allocated to the data bits of the upper portion of the image data to be stored in the first display memory 7*a* in order from the most significant bit (bit 7) to the lowermost bit (bit 4) in the row direction. The memory cells of every four of the even numbered columns are allocated to the data bits of the lower portion of the image data to be stored in the second display memory 7*b* in order from the uppermost bit (bit 3) to the least significant bit (bit 0) in the row direction.

A sense amplifier is provided for each of the columns of the memory cells. The second selectors 12-1, 12-2, . . . of the second selector section 12 are provided for the odd numbered columns, and the third selectors 13-1, 13-2, . . . of the third selector section 13 are provided for the even numbered columns. The latch section 8 contains n×8 latch circuits. Each of the latch circuits corresponding to the odd numbered columns is connected with a corresponding second selector 12 and a corresponding third selector 13 corresponding to the even numbered column which is provided in the neighbor to it in the row direction.

According to the controller driver 2 of the present invention, by using the structure of the first display memory 7*a*, the second display memory 7*b*), the second selector section 12, the third selector section 13 and the latch section 8 shown in FIG. 13, the wiring line intersections reduces. Therefore, according to the controller driver 2 of the present invention, the small size can be realized and consumption power does not increase.

Figure 14:
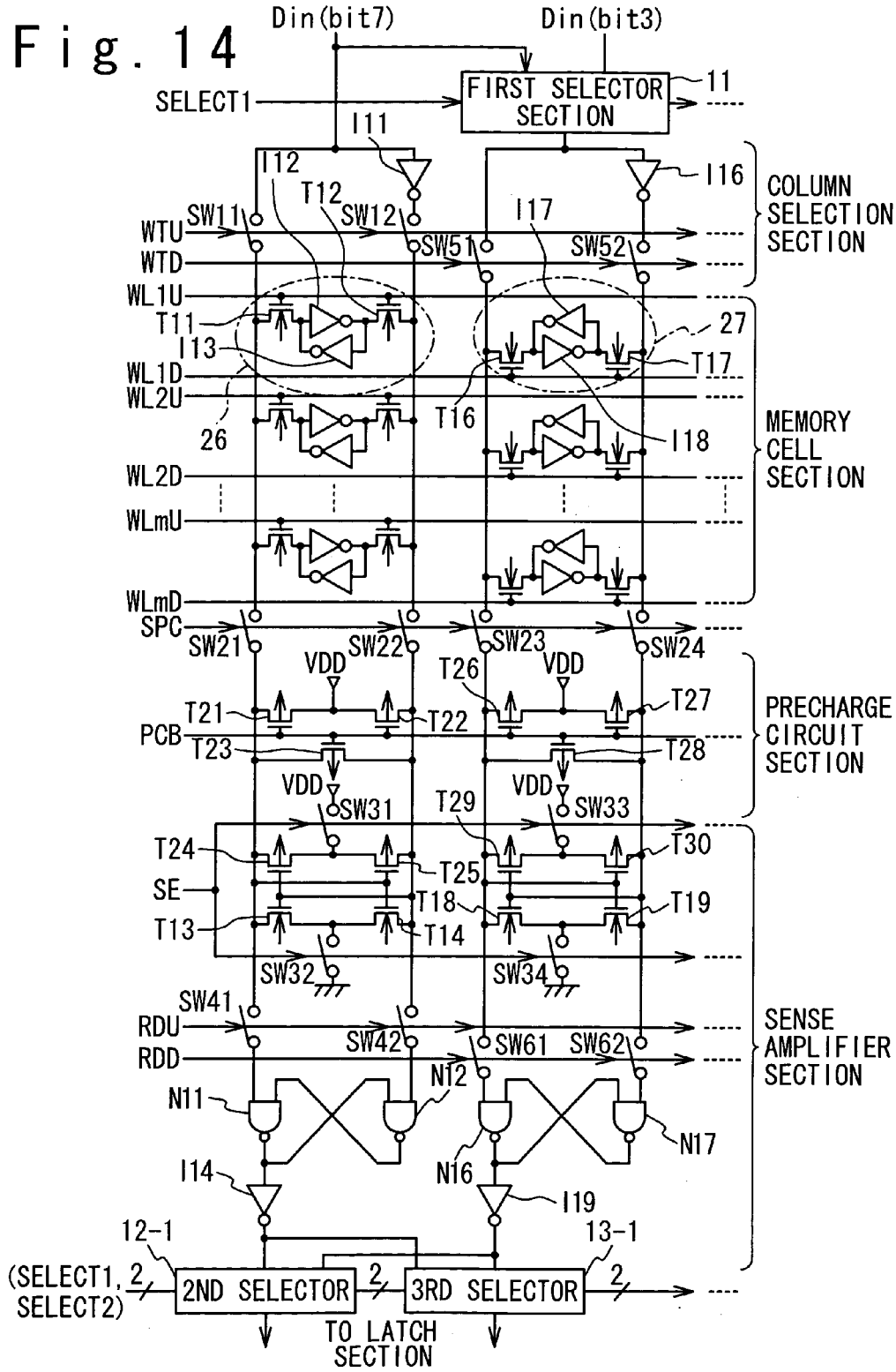
FIG. 14 is a block diagram showing the structure of a display memory section, a second selector section, a third selector section and a latch section in the control driver of the present invention.

FIG. 14 is a circuit diagram showing the structure of a part of the display memory corresponding to the bit 7 and bit 3 of the display data in the control driver of the present invention. The structures of the columns for the other bits in the display memory section 107 are the same. The columns contain a column selection section, a memory cell section, a precharge circuit section and a sense amplifier section.

Referring to FIG. 14, as described above, a latch section (not shown) is provided between the first selector section 11 and the display memory section 7.

In the column selection section of the display memory section 7, the data bit Din (bit 7) of a pixel of the image data as the data bit 7 of the display data is connected with a pair of bit lines, that is, with the bit line Bj(7) of the pair via a switch SW11 and with the bit line Bj'(7) via an inverter I11 and a switch SW12. The bit data Din (bit 7) and the bit data Din (bit 3) are connected with the first selector section 11, and one of them is selected as the data bit 3 of the display data.

The bit 3 of the display data is connected with a bit line Bj(3) of a pair via a switch SW51 and with the bit line Bj'(3) of the pair via an inverter I16 and a switch SW52. The switches SW11 and SW12 are turned on in response to the write signal WTU for the first display memory 7*a* supplied to the memory control circuit 6, and the switches SW51 and SW52 are turned on in response to the write signal WTD for the second display memory 7*b* supplied to the memory control circuit 6.

In the memory cell section, the memory cells of the column for the bit 7 of the display data are connected with the pair of bit lines Bj(7) and Bj'(7) and are connected with the word lines WLiU. Each memory cell for the bit 7 of the display data contains an N-channel MOS transistor T11, a latch element and an N-channel MOS transistor T12 which are connected in series between the bit lines Bj(7) and Bj'(7) of the pair. The latch element contains two inverters I12 and I13 which are connected in parallel in opposite directions. The gates of the N-channel MOS transistors T11 and T12 are connected with the corresponding word line WLiU.

The memory cells of the column for the bit 3 of the display data are connected with the pair of bit lines Bj(3) and Bj'(3) and are connected with the word lines WLiD. Each memory cell for the bit 3 of the display data contains an N-channel MOS transistor T16, a latch element and an N-channel MOS transistor T17 which are connected in series between the bit lines Bj(3) and Bj'(3) of the pair. The latch element contains two inverters I17 and I18 which are connected in parallel in opposite directions. The gates of the N-channel MOS transistors T16 and T17 are connected with the corresponding word line WLiD.

The memory cell section for the bit 7 of the display data is connected with the precharge circuit section via switches SW21 and SW22, and the memory cell section for the bit 3 of the display data is connected with the precharge circuit section via switches SW23 and SW24. The switches SW21 and SW122 are turned on a sense precharge control signal SPC which is supplied from the memory control circuit 106 in response to the memory control signal.

In the precharge circuit section for the bit 7 of the display data, two P-channel MOS transistors T21 and T22 are connected between the bit lines Bj(7) and Bj'(7) of the pair, and a node between the two P-channel MOS transistors T21 and T22 is connected with the power supply VDD. The gates of the two P-channel MOS transistor T21 and T22 are connected with a precharge signal PCB which is supplied from the memory control circuit 6 in response to the memory control signal. Thus, when the two P-channel MOS transistors T21 and T22 are turned on in response to the precharge signal PCB, the bit lines Bj(7) and Bj'(7) are precharged. Also, a P-channel MOS transistor T23 is connected between the bit lines Bj(7) and Bj'(7) of the pair. The gate of the P-channel MOS transistor T23 is connected with the precharge signal PCB. Thus, the potentials of the bit lines Bj(7) and Bj'(7) are equalized in response to the precharge signal PCB.

Also, in the precharge circuit section for the bit 3 of the display data, two P-channel MOS transistors T29 and T30 are connected between the bit lines Bj(3) and Bj'(3) of the pair, and a node between the two P-channel MOS transistors T29 and T30 is connected with the power supply VDD. The gates of the two P-channel MOS transistor T29 and T30 are connected with the precharge signal PCB supplied from the memory control circuit 6. Thus, when the two P-channel MOS transistors T29 and T30 are turned on in response to the precharge signal PCB, the bit lines are precharged. Also, a P-channel MOS transistor T28 is connected between the bit lines Bj(3) and Bj'(3) of the pair. The gate of the P-channel MOS transistor T28 is connected with the precharge signal PCB. Thus, the potentials of the bit lines Bj(3) and Bj'(3) are equalized in response to the precharge signal PCB.

In the sense amplifier section for the bit 7 of the display data, two P-channel MOS transistors T24 and T25 are connected between the bit lines Bj(7) and Bj'(7) of the pair, and a node between the two P-channel MOS transistors T24 and T25 is connected with the power supply voltage VDD via a switch SW31. Also, two N-channel MOS transistors T13 and T14 are connected between the bit lines Bj(7) and Bj'(7) of the pair, and a node between the two N-channel MOS transistors T13 and T14 is connected with the ground GND via a switch SW32. The gates of the P-channel MOS transistor T25 and N-channel MOS transistor T14 are connected with the bit line Bj(7) of the pair, and the gates of the P-channel MOS transistor T24 and N-channel MOS transistor T13 are connected with the bit line Bj(7) of the pair. The switches SW31 and SW32 are turned on in response to a sense amplifier enable signal SE which is supplied from the memory control circuit 6 in response to the memory control signal. Thus, when the potential of one Bj(7) of the bit lines is higher than that of the other Bj'(7) of the bit lines, the P-channel MOS transistor T24 goes to the ON state and the P-channel MOS transistor T25 goes to the OFF state. Also, the N-channel MOS transistor T13 goes to the OFF state and the N-channel MOS transistor T13 goes to the ON state. In this way, a difference of the potentials on the bit lines Bj(7) and Bj'(7) is amplified.

Also, in the sense amplifier section for the bit 3 of the display data, two P-channel MOS transistors T29 and T30 are connected between the bit lines Bj(3) and Bj'(3) of the pair, and a node between the two P-channel MOS transistors T29 and T30 is connected with the power supply voltage VDD via a switch SW33. Also, two N-channel MOS transistors T18 and T19 are connected between the bit lines Bj(3) and Bj'(3) of the pair, and a node between the two N-channel MOS transistors T18 and T19 is connected with the ground GND via a switch SW34. The gates of the P-channel MOS transistor T30 and N-channel MOS transistor T19 are connected with the bit line Bj(3) of the pair, and the gates of the P-channel MOS transistor T29 and N-channel MOS transistor T18 are connected with the bit line Bj'(3) of the pair. The switches SW33 and SW34 are turned on in response to the sense amplifier enable signal SE supplied from the memory control circuit 6. Thus, when the potential of one Bj(3) of the bit lines is higher than that of the other Bj'(3) of the bit lines, the P-channel MOS transistor T29 goes to the ON state and the P-channel MOS transistor T30 goes to the OFF state. Also, the N-channel MOS transistor T18 goes to the OFF state and the N-channel MOS transistor T19 goes to the ON state. In this way, a difference of the potentials on the bit lines Bj(3) and Bj'(3) is amplified.

Also, in the sense amplifier section for the bit 7 of the display data, a flip-flop of NAND gates N11 and N12 is provided and connected with the bit lines Bj(7) and Bj'(7) of the pair via switches SW41 and SW42. The switches SW41 and SW42 are turned on in response to a read signal RDU which is supplied from the memory control circuit 6 in response to the memory control signal. Thus, the potential difference is latched by the flip-flop. The output of the NAND gate N11 is connected with an inverter I14, and the output of the flip-flop is outputted to the second selector section 12-1 and the third selector section 13-1 via the inverter I14.

Also, in the sense amplifier section for the bit 3 of the display data, a flip-flop of NAND gates N16 and N17 is provided and connected with the bit lines Bj(3) and Bj'(3) of the pair via switches SW61 and SW62. The switches SW61 and SW62 are turned on in response to a read signal RDD which is supplied from the memory control circuit 6 in response to the memory control signal. Thus, the potential difference is latched by the flip-flop. The output of the NAND gate N16 is connected with an inverter I19, and the output of the flip-flop is outputted to the second selector section 12-1 and the third selector section 13-1 via the inverter I19.

Next, the operation of the mobile terminal to which the control driver of the present invention is applied will be described with reference to FIGS. 10 to 12, and FIGS. 15A to 20J.

Figure 10:
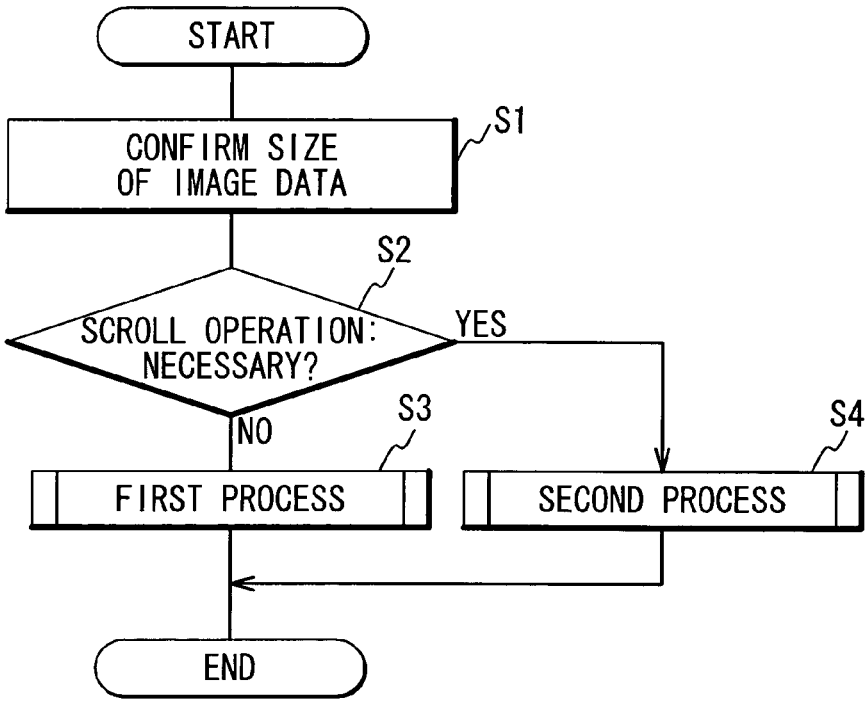
FIG. 10 is the flow chart showing an operation of the mobile terminal to which the control driver of the present invention is applied.

FIG. 10 is a flow chart showing the operation of the mobile terminal to which the control driver of the present invention is applied.

First, the mobile terminal 16 receives image data externally and the image drawing unit 1 confirms the size of the image data (Step S1). The image drawing unit 1 determines whether or not it is possible to display the image data on the display section 3 in one screen. That is, it is determined whether or not it is necessary for the image drawing unit 1 to instruct a scroll operation (Step S2). Also, the image drawing unit 1 outputs the image data toward the display memory section 7 and the memory control signal containing the image data size signal, the write/read mode, and the address toe memory control circuit 6.

When the scroll instruction is not necessary, i.e., the size of the image data is not larger than that of the screen (step S2-NO), the mobile terminal 16 carries out the first process (Step S3). When the scroll instruction is necessary, i.e., the size of the image data is larger than the screen and the image data has first image data and second image data (Step S2-YES), the mobile terminal 16 carries out a second process (Step S4).

Figure 11:
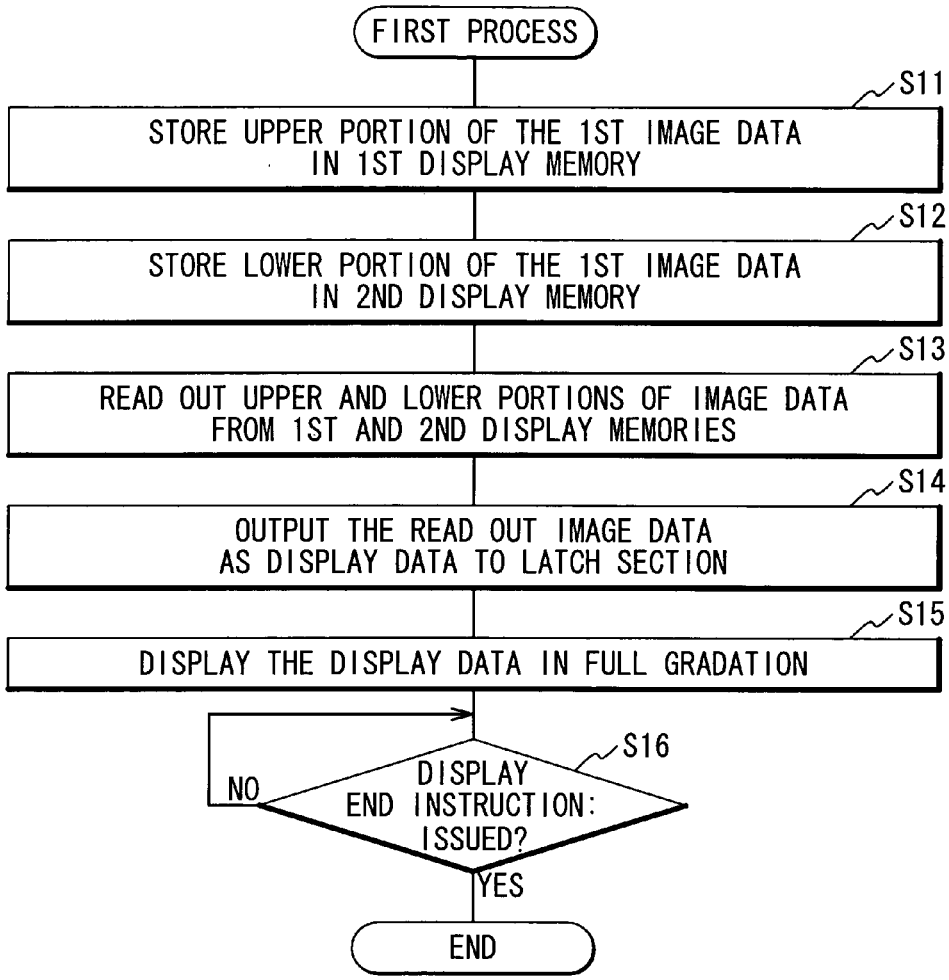
FIG. 11 is a flow chart showing the first process of the mobile terminal to which the control driver of the present invention is applied.

FIG. 11 is s flow chart showing the first process (step S3) as the operation of the mobile terminal to which the control driver of the present invention is applied.

At steps S11 and S12, the upper portion and lower portion of the image data are written in the first and second display memories 7*a* and 7*b*. At this time, the image data has only the first image data. The control driver 2 carries out a write operation of the first process during the write period 0 to a4. The write operation contains a precharge period, a data determination period and a data write period. The precharge period is a period 0 to a1, the data determination period is a period a1 to a2, and the data write period is a period a2 to a3, and an end period a3 to a4.

More specifically, in the precharge period of the write period of the first process (step S3), the memory control circuit 6 generates the first select signal SELECT1 in the low level and the second select signal SELECT2 in the low level based on the memory control signal in response to the timing signal and outputs the first select signal SELECT1 to the first to third selector sections 11 to 13 and the second select signal SELECT2 to the second and third selector sections 12 and 13. Thus, the first selector section 11 is set to select the lower portion of the first image data. The upper portion of the first image data and the selected lower portion of the first image data are latched by a latch section (not shown). Also, the memory control circuit 6 outputs the first and second write start addresses to the word line decoder 21 and the bit line decoder 22. The word line decoder 21 and the bit line decoder 22 start the decoding operations.

Figures 15A, 15B, 15C, 15D, 15E, 15F, 15G, 15H, 15I, 15J:
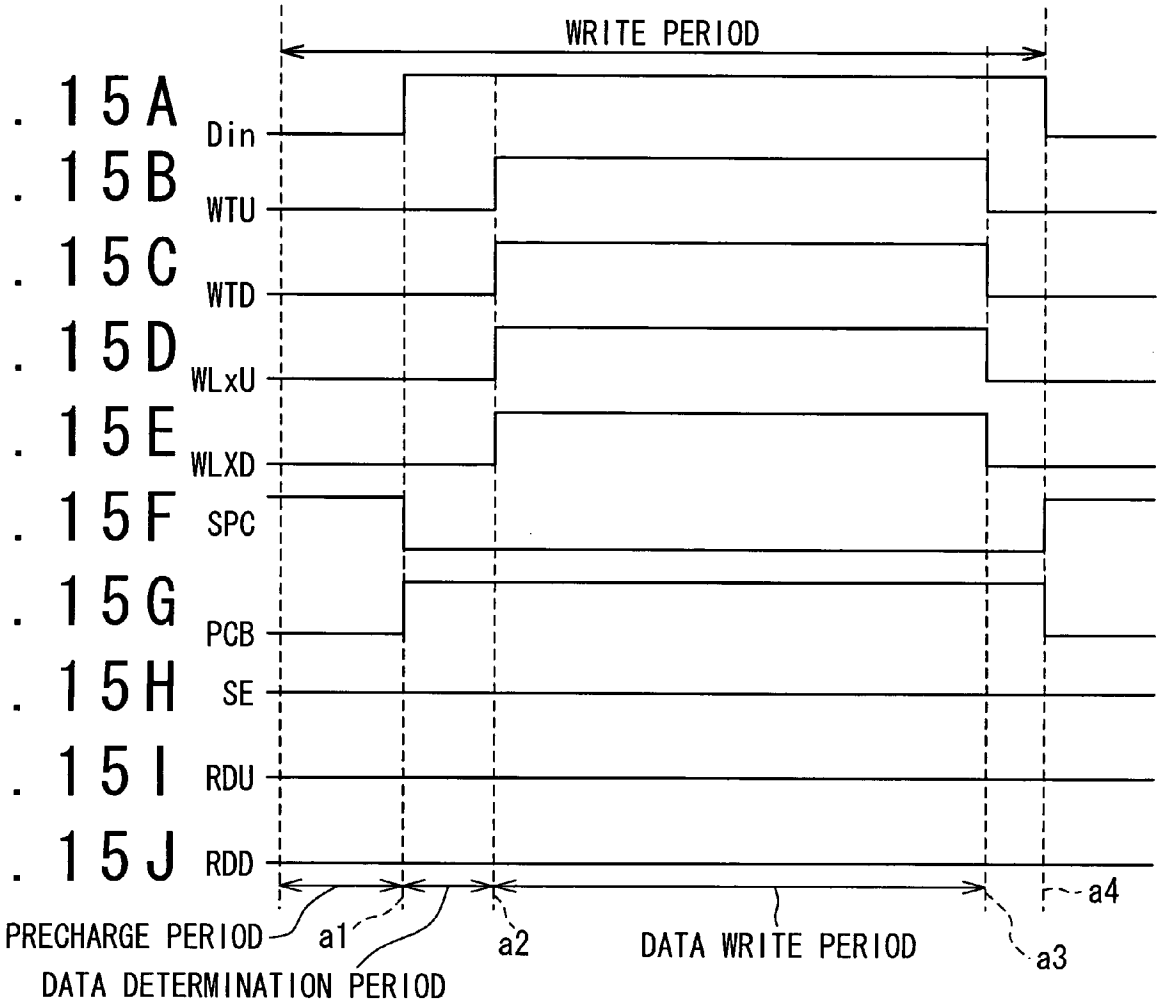
FIGS. 15A to 15J are timing charts showing a write operation in the first process of the control driver of the present invention.

Also, the memory control circuit 6 outputs the display memory control signal containing the sense precharge control signal SPC in the high level and the precharge signal PCB in the low level to the display memory section 7 based on the memory control signal in response to the timing signal, as shown in FIGS. 15F and 15G. The switches SW21 to SW24 are turned on in response to the sense precharge control signal SPC to connect the memory cell section and the precharge circuit section. Also, the P-channel MOS transistors T21 to T23, T26 to T28, . . . are turned on in response to the precharge signal PCB so that the pairs of bit lines Bj(7) and Bj' (7), Bj(3) and Bj' (3), . . . are precharged and equalized to a predetermined potential.

Subsequently, in the data determination period, the signal SPC is set to the low level and the signal PCB is set to the high level. As a result, the switches SW21 to SW24 are turned off, and the P-channel MOS transistors T21 to T23, T26 to T28, . . . are also turned off. The latch section (not shown) outputs the latched first image data to the first and second display memories 7*a* and 7*b*, as shown in FIG. 15A.

Subsequently, in the data write period, the bit line decoder 22 of the display memory section 7 drives all the pairs of the bit lines based on the decoding result of the first and second X addresses. The word line decoder 21 of the display memory section 7 drives the two word lines WLxU and WLxD based on the decoding result of the first and second Y addresses, as shown in FIGS. 15D and 15E. As a result, for example, the N-channel MOS transistors T11 and T12, T16 and T17, . . . are turned on. Also, the memory control circuit 6 outputs the display memory signal containing the write signals WTU and WTD shown in FIGS. 15B and 15C to the display memory section 7 in response to the timing signal. The switches SW11 and SW12, SW51 and SW52, . . . are turned on in response to the write signals WTU and WTD so that the data bits of each pixel of the first image data are connected with the pairs of bit lines. As a result, the bit lines Bj(7) and Bj'(7), Bj(3) and Bj(3), . . . of each pair are set to different potentials based on the data bit.

Thus, the data bits of the image data are latched or stored by the latch element of the memory cells connected with the word lines WLxU and WLxD.

Subsequently, at the time a3 of the write period, the write signals WTU and WTD are set to the low level so that the switches SW11 and SW12, SW51 and SW52, . . . are turned off. Also, the word line decoder 21 of the display memory section 7 sets the word lines WLxU and WLxD to the low level so that the N-channel MOS transistors T11 and T12, T16 and T17, . . . are turned off.

Subsequently, at the time a4, the sense precharge control signal SPC and the precharge signal PCB are set again to the high level and the low level, respectively. Thus, the write operation can be repeated.

In this way, the upper portion and lower portion of the image data are stored in the first and second display memories 7*a* and 7*b* in units of the word lines. That is, the steps S11 and S12 are carried out at the same time.

At a step S13, a read operation of the first process (step S3) is carried out and the upper portion and lower portion of the image data are read out from the first and second display memories 7*a* and 7*b* and displayed on the display section 3. A read period 0 to b5 of the read operation contains a precharge period, a data read operation period, a sense operation period, a data output period and another period. The precharge period is a period 0 to b1, the data read operation period is a period b1 to b2, the sense operation period is a period b2 to b3, the data output period is a period b3 to b4, and the other period is a period b4 to b5.

Also, the memory control circuit 6 outputs the first and second read start addresses to the word line decoder 21 and the bit line decoder 22. The word line decoder 21 and the bit line decoder 22 start the decoding operations.

Figures 16A, 16B, 16C, 16D, 16E, 16F, 16G, 16H, 16I, 16J:
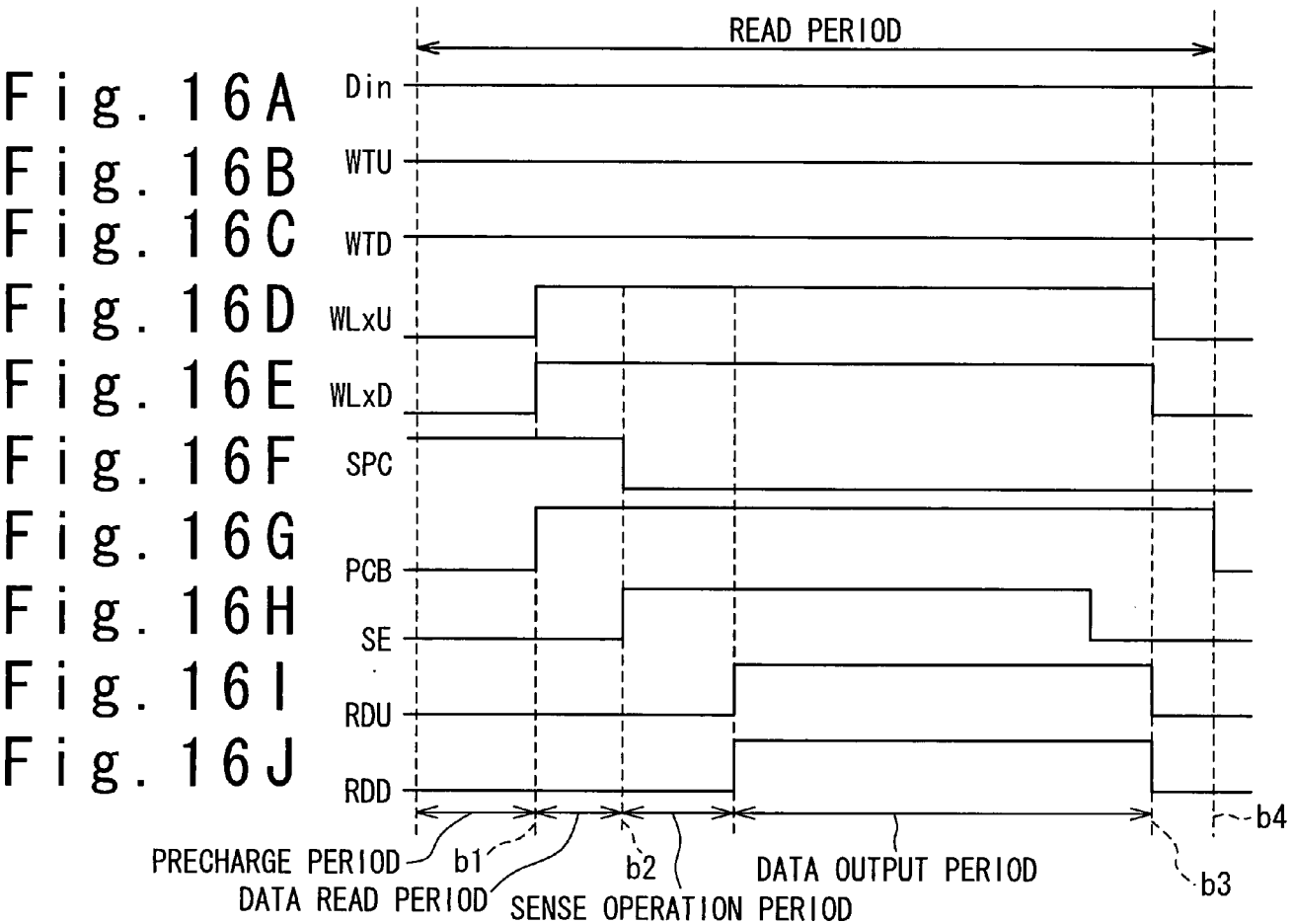
FIGS. 16A to 16G are timing charts showing a read operation in the first process of the control driver of the present invention.

More specifically, in the precharge period of the read period, the sense precharge control signal SPC is set to the high level as shown in FIG. 16F, and the precharge signal PCB is set to the low level as shown in FIG. 16G. As a result, the switches SW21 and S22, SW23 and SW24, . . . are turned on in response to the signal SPC to connect all the pairs of bit lines of the memory cell section and all the pairs of the bit lines of the precharge circuit section. Also, the P-channel MOS transistors T21 to T23, T26 to T28, . . . are turned on in response to the precharge signal PCB so that all the pairs of the bit lines are precharged and equalized to a predetermined potential.

Subsequently, in the data read period of the first process, the signal PCB is set to in the high level. As a result, the P-channel MOS transistors T21 to T23, T26 to T28, . . . are turned off. The word line decoder 21 of the display memory section 7 drives the word lines WLxU and WLxD based on the decode result, as shown in FIGS. 16D and 16E. Thus, the data bits are read out from the memory cells connected with the driven word lines WLxU and WLxD, and transferred on the bit lines of the pairs in the form of potentials.

Subsequently, in the sense operation period, the sense precharge control signal SPC is set to the low level so that the switches SW21 and S22, SW23 and SW24, . . . are turned off. Also, the memory control circuit 6 generates the sense amplifier enable signal SE. The switches SW31 and SW32, SW33 and SW34, . . . are turned on in response to the signal SE. Thus, the potentials on the bit lines of each pair are amplified by the P-channel MOS transistors T24 and T25, T29 and T30, . . . and the N-channel MOS transistors T13 and T14, T18 and T19, . . .

Subsequently, in the data output period, the memory control circuit 6 generates the read signals RDU and RDD and supplies them to the first and second display memories 7*a* and 7*b*. The flip-flops N11 and N12, N16 and N17, . . . latch the amplified potentials as the data bits of the display data in response to the read signals RDU and RDD. The latched data bits are outputted to the second and third selector sections 12 and 13 via the inverters I14, I19, . . . . Specifically, each data bit is outputted to the corresponding second and third selectors 12-1 and 13-1. The first select signal SELECT1 in the low level and the second select signal SELECT2 in the high level are previously outputted from the memory control circuit 6. Therefore, the second selector 12-1 selects the output from the inverter I14 and outputs to the latch section 8, and the third selector section 13-1 selects the output from the inverter I19 and outputs to the latch section 8. During the data output period, the sense amplifier enable signal SE is set to the low level so that the switches SW31 and SW32, SW33 and SW34, . . . are turned off. At the time b4, the word lines WLxU and WLxD and the read signals RDU and RDD are set to the low level.

Thereafter, at a step S15, when the data bits of the display data for the gate line are latched by the latch section 8, the display data is outputted to the data line drive circuit 9. The data line drive circuit 9 drives the data lines based on the data bits of the display data and the gradation voltages in response to the timing signal. Also, the gate line drive circuit 5 drives the gate line. In this way, the image corresponding to the display data for the gate line is displayed on the display section 3 in the full gradation.

When the user operates the input unit 15 and instructs a screen display end (step S16-YES), the operation of the mobile terminal 16 ends.

Figure 12:
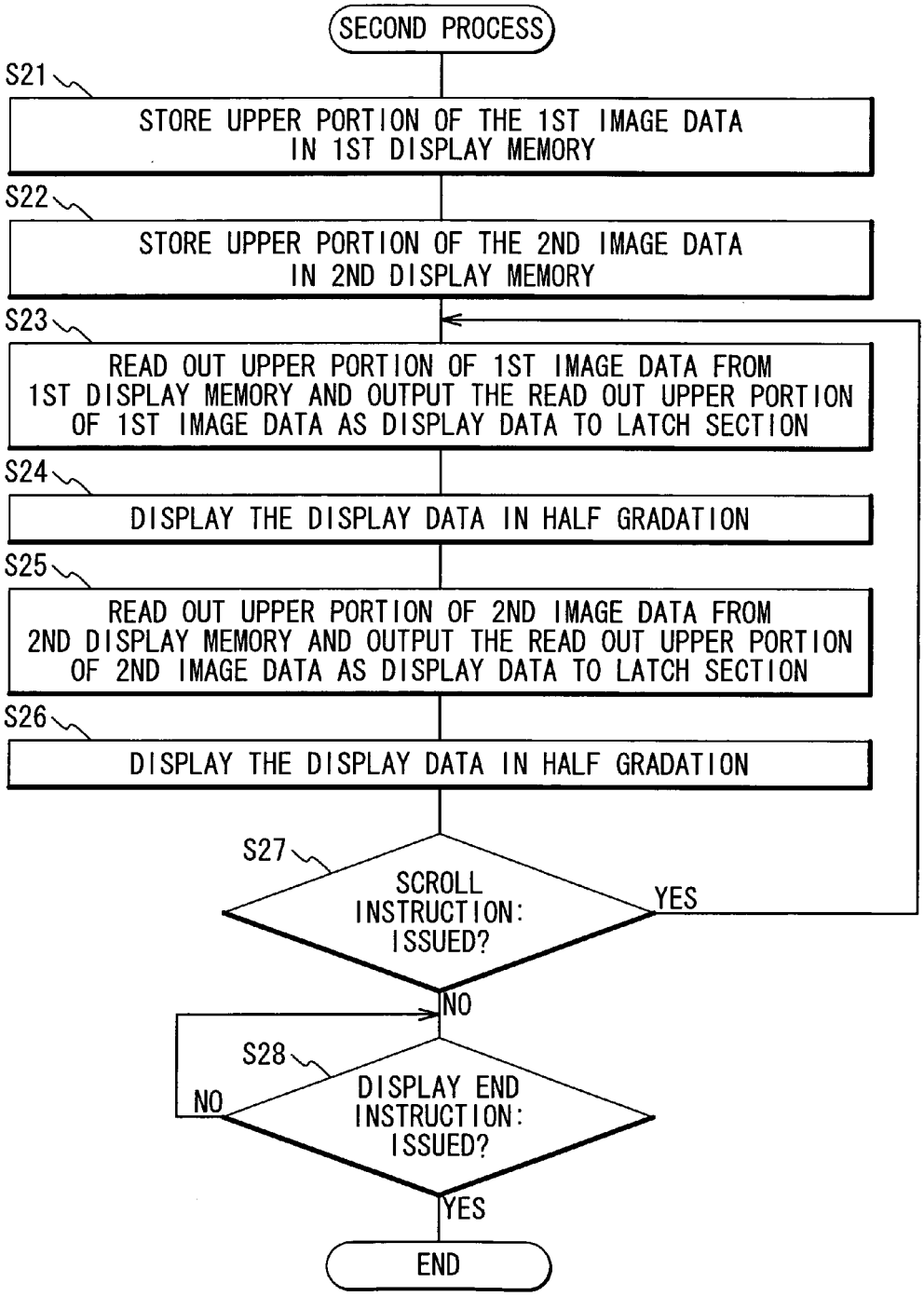
FIG. 12 is a flow chart showing the second process of the mobile terminal to which the control driver of the present invention is applied.

FIG. 12 is a flow chart showing the second process (step S4) as the operation of the mobile terminal to which the control driver of the present invention is applied. In case of the second process, the image data has first image data and second image data. Different write and read operations are carried out to the first and second image data.

At a step S21, only the upper portion of the first image data is written in the first display memory 7*a*. The control driver 2 carries out a write operation of the second process during the write period 0 to a4, as shown in FIGS. 17A to 17J. The write operation contains a precharge period, a data determination period and a data write period. The precharge period is a period 0 to a1, the data determination period is a period a1 to a2, and the data write period is a period a2 to a3, and an end period a3 to a4.

More specifically, in the precharge period of the write period of the second process (step S4), the memory control circuit 6 generates the first select signal SELECT1 in the high level and the second select signal SELECT2 in the low level based on the memory control signal in response to the timing signal and outputs the first select signal SELECT1 to the first to third selector sections 11 to 13 and the second select signal SELECT2 to the second and third selector sections 12 and 13. Thus, the first selector section 11 is set not to select the lower portion of the first image data. The upper portion of the first image data is latched by a latch section (not shown). Also, the memory control circuit 6 outputs the first write start address to the word line decoder 21 and the bit line decoder 22. The word line decoder 21 and the bit line decoder 22 start the decoding operations.

Figures 17A, 17B, 17C, 17D, 17E, 17F, 17G, 17H, 17I, 17J:
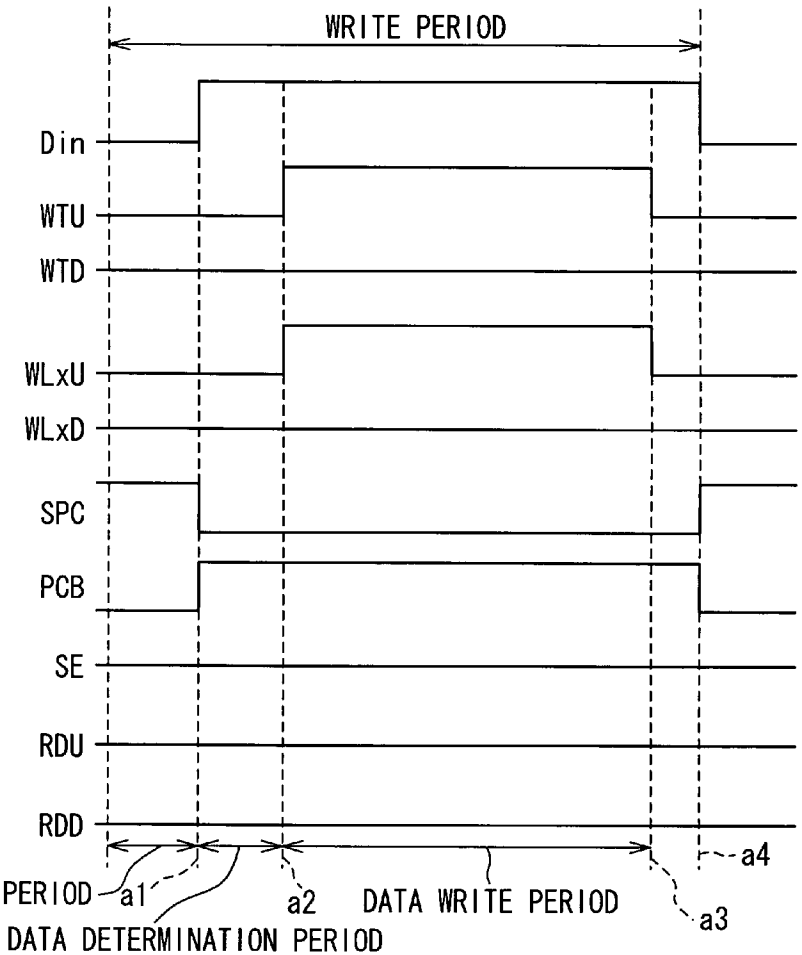
FIGS. 17A to 17J are timing charts showing a write operation of the second process in the control driver of the present invention.

Also, the memory control circuit 6 outputs the display memory control signal containing the sense precharge control signal SPC in the high level and the precharge signal PCB in the low level to the display memory section 7 based on the memory control signal in response to the timing signal, as shown in FIGS. 17F and 17G. The switches SW21 to SW24 in the first display memory 7*a* are turned on in response to the sense precharge control signal SPC to connect the memory cell section and the precharge circuit section.

Also, the P-channel MOS transistors T21 to T23, . . . in the first display memory 7*a* are turned on in response to the precharge signal PCB so that the pairs of bit lines Bj(7) and Bj'(7), Bj(3) and Bj'(3), . . . are precharged and equalized to a predetermined potential.

Subsequently, in the data determination period, the signal SPC is set to the low level and the signal PCB is set to the high level. As a result, the switches SW21 and SW22 are turned off, and the P-channel MOS transistors T21 to T23, T26 to T28, . . . are also turned off. The latch section (not shown) outputs the latched upper portion of the first image data to the first display memory 7*a*, as shown in FIG. 17A.

Subsequently, in the data write period, the bit line decoder 22 of the display memory section 7 drives all the pairs of the bit lines in the first display memory 7*a* based on the decoding result of the first X address. The word line decoder 21 of the display memory section 7 drives the word line WLxU based on the decoding result of the first Y address, as shown in FIGS. 17D and 17E. As a result, for example, the N-channel MOS transistors T11 and T12, . . . in the first display memory 7*a* are turned on. Also, the memory control circuit 6 outputs the display memory signal containing the write signal WTU shown in FIGS. 17B and 17C to the display memory section 7 in response to the timing signal. The switches SW11 and SW12, . . . in the first display memory 7*a* are turned on in response to the write signal WTU so that the data bits of each pixel in the upper portion of the first image data are connected with the pairs of bit lines. As a result, the bit lines Bj(7) and Bj'(7), . . . of each pair in the first display memory 7*a* are set to different potentials based on the data bit. Thus, the data bits of the upper portion of the first image data are latched or stored by the latch element of the memory cells connected with the word line WLxU in the first display memory 7*a*.

Subsequently, at the time a3 of the write period, the write signal WTU is set to the low level so that the switches SW11 and SW12, . . . are turned off. Also, the word line decoder 21 of the display memory section 7 sets the word line WLxU to the low level so that the N-channel MOS transistors T11 and T12, . . . are turned off.

Subsequently, at the time a4, the sense precharge control signal SPC and the precharge signal PCB are set again to the high level and the low level, respectively. Thus, the write operation can be repeated.

In this way, the upper portion of the first image data is stored in the first display memory 7*a* in units of the word lines.

Next, at a step S22, only the upper portion of the second image data is written in the second display memory 7*b*. The control driver 2 carries out a write operation of the second process during the write period 0 to a4, as shown in FIGS. 18A to 18J. A write period of the write operation contains a precharge period, a data determination period and a data write period. The precharge period is a period 0 to a1, the data determination period is a period a1 to a2, and the data write period is a period a2 to a3, and an end period a3 to a4.

More specifically, in the precharge period of the write period of the first process (step S4), the first select signal SELECT1 in the low level and the second select signal SELECT2 in the low level are held. Thus, the first selector section 11 is set to select the upper portion of the second image data. The upper portion of the second image data is latched by the latch section (not shown). Also, the memory control circuit 6 outputs the second write start address to the word line decoder 21 and the bit line decoder 22. The word line decoder 21 and the bit line decoder 22 start the decoding operations.

Figures 18A, 18B, 18C, 18D, 18E, 18F, 18G, 18H, 18I, 18J:
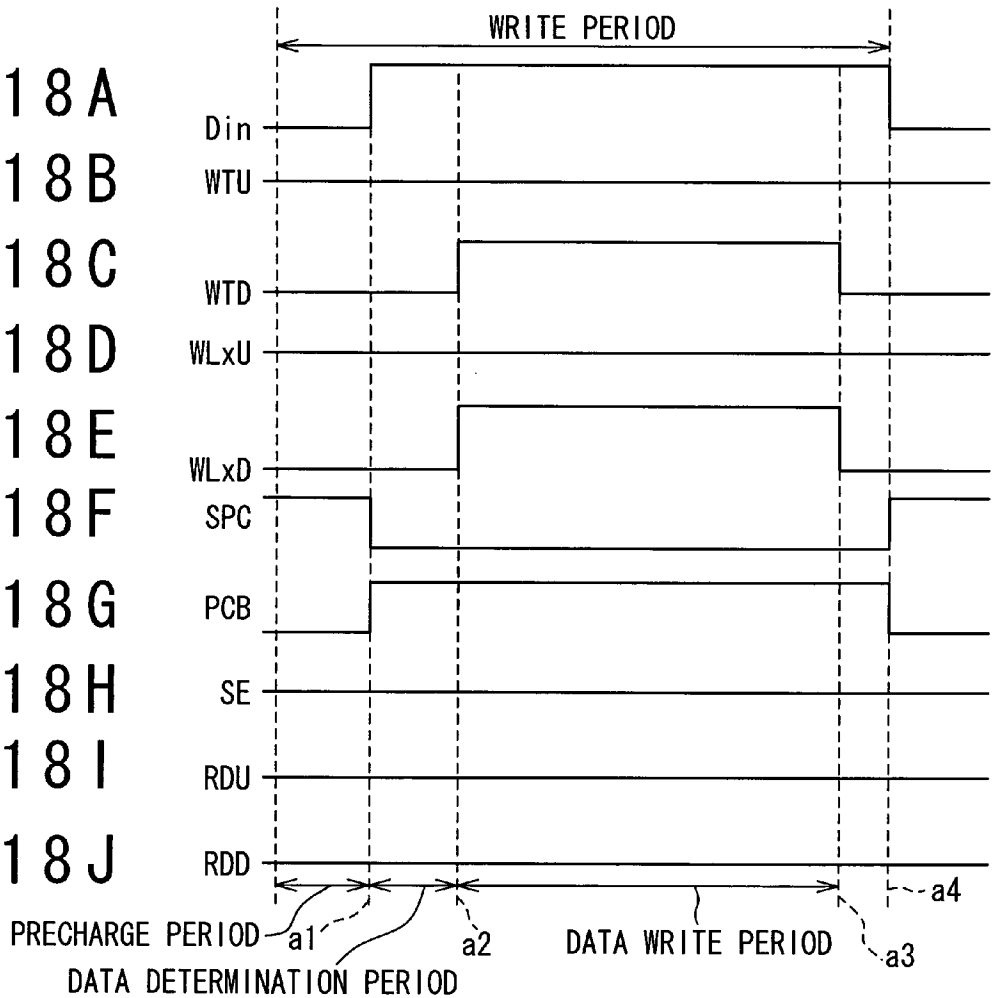
FIGS. 18A to 18J are timing charts showing a write operation of the third process in the control driver of the present invention.

Also, the memory control circuit 6 outputs the display memory control signal containing the sense precharge control signal SPC in the high level and the precharge signal PCB in the low level to the display memory section 7 based on the memory control signal in response to the timing signal, as shown in FIGS. 18F and 18G. The switches SW21 to SW24 are turned on in response to the sense precharge control signal SPC to connect the memory cell section and the precharge circuit section. Also, the P-channel MOS transistors T21 to T23, T26 to T28, . . . are turned on in response to the precharge signal PCB so that the pairs of bit lines Bj(7) and Bj'(7), Bj(3) and Bj'(3), . . . are precharged and equalized to a predetermined potential.

Subsequently, in the data determination period, the signal SPC is set to the low level and the signal PCB is set to the high level. As a result, the switches SW21 to 24 are turned off, and the P-channel MOS transistors T21 to T23, T26 to T28, . . . are also turned off. The latch section (not shown) outputs the latched upper portion of the second image data to the second display memory 7*b*, as shown in FIG. 18A.

Subsequently, in the data write period, the bit line decoder 22 of the display memory section 7 drives all the pairs of the bit lines based on the decoding result of the second X address. The word line decoder 21 of the display memory section 7 drives the word line WLxD based on the decoding result of the second Y address, as shown in FIGS. 18D and 18E. As a result, for example, the N-channel MOS transistors T16 and T17, . . . in the second display memory 7*b* are turned on. Also, the memory control circuit 6 outputs the display memory signal containing the write signal WTD shown in FIGS. 18B and 18C to the display memory section 7 in response to the timing signal. The switches SW51 and SW52, . . . in the second display memory 7*b* are turned on in response to the write signal WTD so that the data bits of each pixel in the upper portion of the second image data are connected with the pairs of bit lines. As a result, the bit lines Bj(3) and Bj'(3), . . . of each pair in the second display memory 7*b* are set to different potentials based on the data bit. Thus, the data bits of the upper portion of the second image data are latched or stored by the latch element of the memory cells in the second display memory 7*b* connected with the word line WLxD.

Subsequently, at the time a3 of the write period, the write signal WTD is set to the low level so that the switches SW51 and SW52, . . . are turned off. Also, the word line decoder 21 of the display memory section 7 sets the word line WLxD to the low level so that the N-channel MOS transistors T16 and T17, . . . are turned off.

Subsequently, at the time a4, the sense precharge control signal SPC and the precharge signal PCB are set again to the high level and the low level, respectively. Thus, the write operation can be repeated.

In this way, the upper portion of the second image data is stored in the second display memory 7*b* in units of the word lines.

Also, through the steps S21 and S22, the upper portion of the first image data and the upper portion of the second image data are stored in the first and second display memories 7*a* and 7*b*.

A read operation (step S23) of the second process (step S4) and a display operation (step S224) are carried out. That is, the upper portion of the first image data is first read out from the first display memory 7*a* and displayed on the display section 3, and then the upper portion of the second image data is read out from the second display memory 7*b* and displayed on the display section 3. A read period 0 to b5 of the first read operation contains a precharge period, a data read operation period, a sense operation period, a data output period and another period, as shown in FIGS. 19A to 19J. The precharge period is a period 0 to b1, the data read operation period is a period b1 to b2, the sense operation period is a period b2 to b3, the data output period is a period b3 to b4, and the other period is a period b4 to b5. At this time, the memory control circuit 6 outputs the first read start address to the word line decoder 21 and the bit line decoder 22. The word line decoder 21 and the bit line decoder 22 start the decoding operations.

Figures 19A, 19B, 19C, 19D, 19E, 19F, 19G, 19H, 19I, 19J:
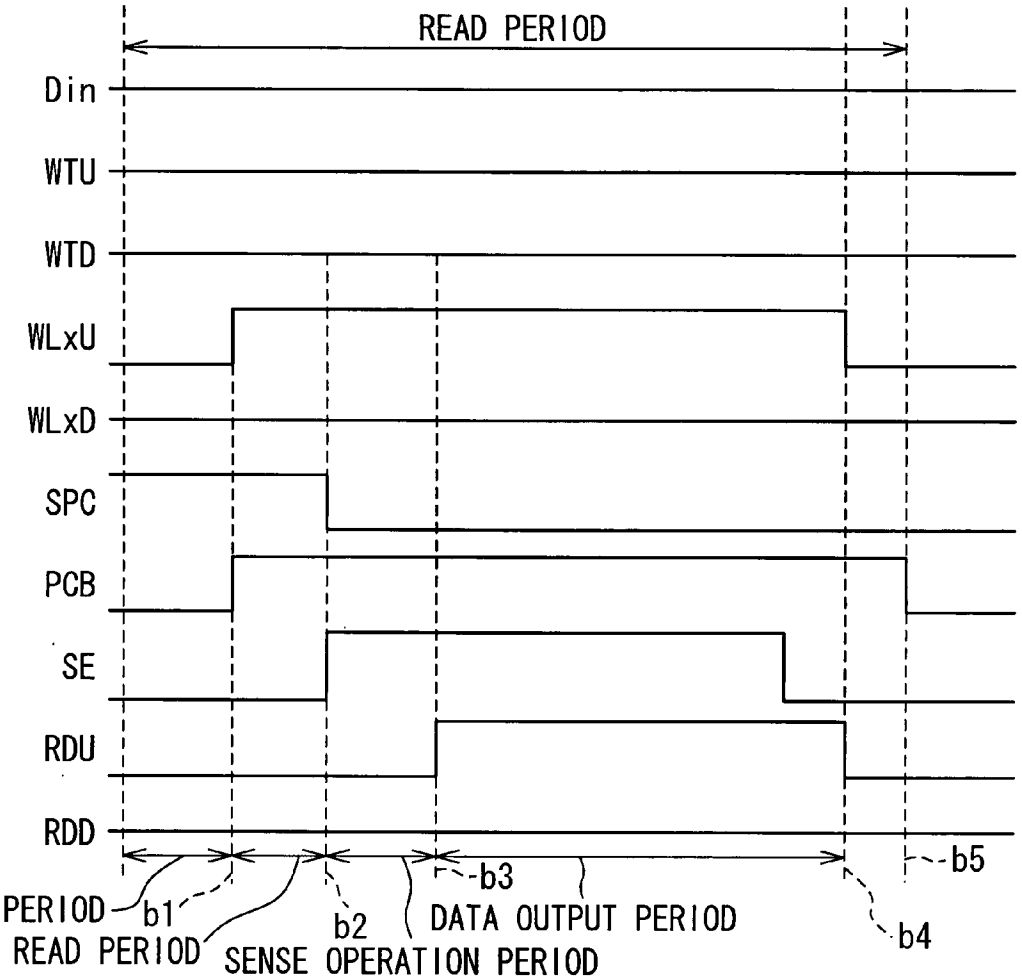
FIGS. 19A to 19*j* are timing charts showing a read operation of the second process in the control driver of the present invention.

More specifically, in the precharge period of the read period, the sense precharge control signal SPC is set to the high level as shown in FIG. 19F, and the precharge signal PCB is set to the low level as shown in FIG. 19G. As a result, the switches SW21 and S22, SW23 and SW24, . . . are turned on in response to the signal SPC to connect all the pairs of bit lines of the memory cell section and all the pairs of the bit lines of the precharge circuit section. Also, the P-channel MOS transistors T21 to T23, T26 to T28, . . . are turned on in response to the precharge signal PCB so that all the pairs of the bit lines are precharged and equalized to a predetermined potential.

Subsequently, in the data read period of the first process, the signal PCB is set to in the high level. As a result, the P-channel MOS transistors T21 to T23, T26 to T28, . . . are turned off. The word line decoder 21 of the display memory section 7 drives only the word line WLxU based on the decode result, as shown in FIGS. 19D and 19E. Thus, the data bits are read out from the memory cells in the first display memory 7*a* connected with the driven word line WLxU, and transferred on the bit lines of the pairs in the form of potentials.

Subsequently, in the sense operation period, the sense precharge control signal SPC is set to the low level so that the switches SW21 and S22, SW23 and SW24, . . . are turned off. Also, the memory control circuit 6 generates the sense amplifier enable signal SE. The switches SW31 and SW32, SW33 and SW34, . . . are turned on in response to the signal SE. Thus, the potentials on the bit lines of each pair in the first display memory 7*a* are amplified by the P-channel MOS transistors T24 and T25, . . . and the N-channel MOS transistors T13 and T14, . . .

Subsequently, in the data output period, the memory control circuit 6 generates the read signal RDU and supplies it to the first display memory 7*a*. The flip-flops N11 and N12, . . . latch the amplified potentials as the data bits of the display data in the first display memory 7*a* in response to the read signal RDU. The latched data bits are outputted to the second and third selector sections 12 and 13 via the inverters I14 . . . . Specifically, each data bit is outputted to the corresponding second and third selectors 12-1 and 13-1. The first select signal SELECT1 in the high level and the second select signal SELECT2 in the low level are previously outputted from the memory control circuit 6. Therefore, the second selector 12-1 selects the output from the inverter I14 and outputs to the latch section 8, and the third selector section 13-1 selects the output from the inverter I14 and outputs to the latch section 8. During the data output period, the sense amplifier enable signal SE is set to the low level so that the switches SW31 and SW32, SW33 and SW34, . . . are turned off. At the time b4, the word lines WLxU and WLxD and the read signals RDU and RDD are set to the low level.

Thereafter, at a step S15, when the data bits of the display data for the gate line are latched by the latch section 8, the display data is outputted to the data line drive circuit 9. The data line drive circuit 9 drives the data lines based on the data bits of the display data and the gradation voltages in response to the timing signal. Also, the gate line drive circuit 5 drives the gate line. In this way, the image corresponding to the first image data for the gate line is displayed on the display section 3 in the half gradation.

When it is necessary to display the second image data, a read operation (step S25) and a display operation (step S26) for the second image data stored in the second display memory 7*b* are carried out.

At a step S25, a read period of the read period 0 to b5 of the read operation contains a precharge period, a data read operation period, a sense operation period, a data output period and another period, as shown in FIGS. 20A to 20J. The precharge period is a period 0 to b1, the data read operation period is a period b1 to b2, the sense operation period is a period b2 to b3, the data output period is a period b3 to b4, and the other period is a period b4 to b5. At this time, the memory control circuit 6 outputs the second read start address to the word line decoder 21 and the bit line decoder 22. The word line decoder 21 and the bit line decoder 22 start the decoding operations. Also, the memory control circuit 6 sets both of the first select signal SELECT1 and the first select signal SELECT1 to the high level to the high level.

Figures 20A, 20B, 20C, 20D, 20E, 20F, 20G, 20H, 20I, 20J:
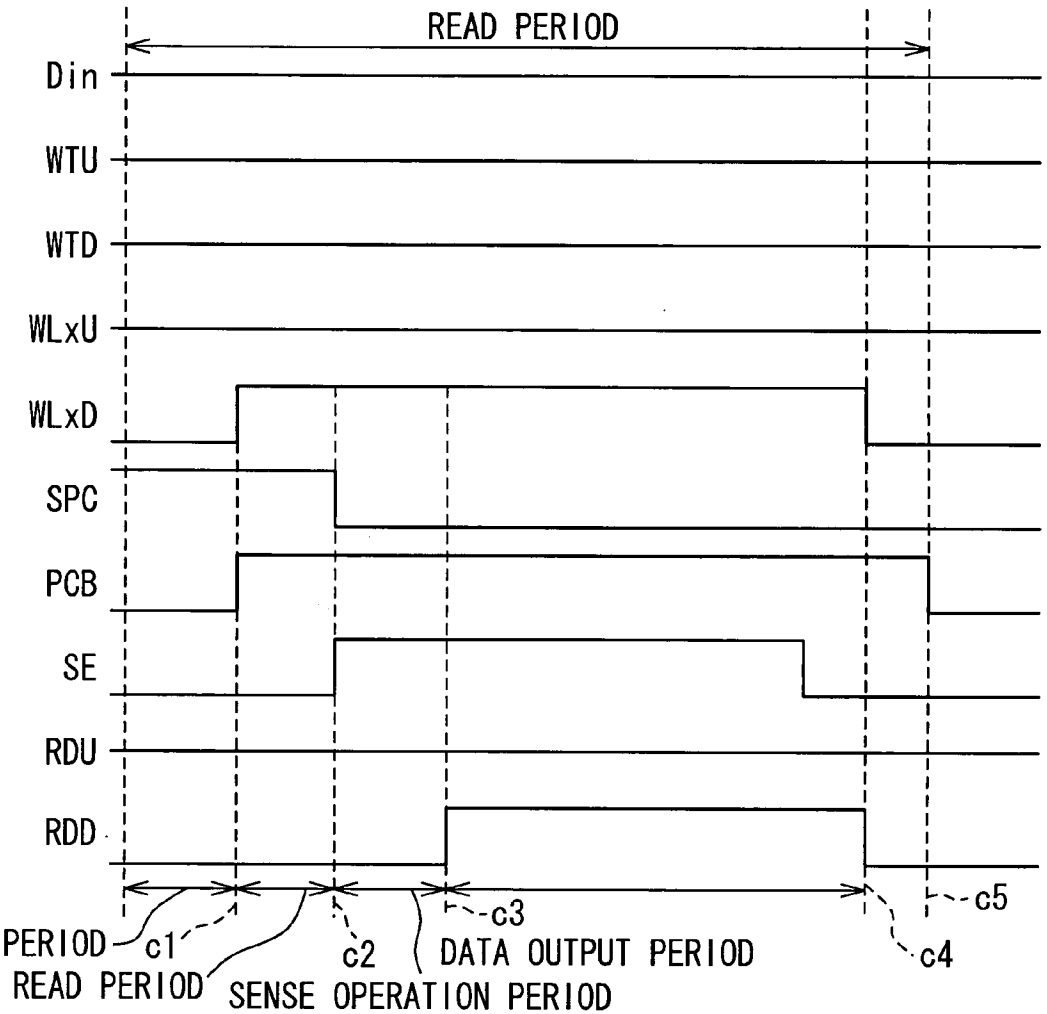
FIGS. 20A to 20J are timing charts showing a read operation of the third process in the control driver of the present invention.

More specifically, in the precharge period of the read period, the sense precharge control signal SPC is set to the high level as shown in FIG. 20F, and the precharge signal PCB is set to the low level as shown in FIG. 20G. As a result, the switches SW21 and S22, SW23 and SW24, . . . are turned on in response to the signal SPC to connect all the pairs of bit lines of the memory cell section and all the pairs of the bit lines of the precharge circuit section. Also, the P-channel MOS transistors T21 to T23, T26 to T28, . . . are turned on in response to the precharge signal PCB so that all the pairs of the bit lines are precharged and equalized to a predetermined potential.

Subsequently, in the data read period of the second process, the signal PCB is set to in the high level. As a result, the P-channel MOS transistors T21 to T23, T26 to T28, . . . are turned off. The word line decoder 21 of the display memory section 7 drives the word line WLxD based on the decode result, as shown in FIGS. 20D and 20E. Thus, the data bits are read out from the memory cells in the second display memory 7*b* connected with the driven word line WLxD, and transferred on the bit lines of the pairs in the form of potentials.

Subsequently, in the sense operation period, the sense precharge control signal SPC is set to the low level so that the switches SW21 and S22, SW23 and SW24, . . . are turned off. Also, the memory control circuit 6 generates the sense amplifier enable signal SE. The switches SW31 and SW32, SW33 and SW34, . . . are turned on in response to the signal SE. Thus, the potentials on the bit lines of each pair in the second display memory 7*b* are amplified by the P-channel MOS transistors T29 and T30, . . . and the N-channel MOS transistors T18 and T19, . . .

Subsequently, in the data output period, the memory control circuit 6 generates the read signal RDD and supplies it to the second display memory 7*b*, as shown in FIGS. 20I and 20J. The flip-flops N16 and N17, . . . latch the amplified potentials as the data bits of the display data in the second display memory 7*b* in response to the read signal RDD. The latched data bits are outputted to the second and third selector sections 12 and 13 via the inverters I14, I19, . . . . Specifically, each data bit is outputted to the corresponding second and third selectors 12-1 and 13-1. The first select signal SELECT1 in the high level and the second select signal SELECT2 in the high level are previously outputted from the memory control circuit 6. Therefore, the second selector 12-1 selects the output from the inverter I19 and outputs to the latch section 8, and the third selector section 13-1 selects the output from the inverter I19 and outputs to the latch section 8. During the data output period, the sense amplifier enable signal SE is set to the low level so that the switches SW31 and SW32, SW33 and SW34, . . . are turned off. At the time b4, the word line WLxD and the read signal RDD are set to the low level.

Thereafter, at a step S26, when the data bits of the display data for the gate line are latched by the latch section 8, the display data is outputted to the data line drive circuit 9. The data line drive circuit 9 drives the data lines based on the data bits of the display data and the gradation voltages in response to the timing signal. Also, the gate line drive circuit 5 drives the gate line. In this way, the image corresponding to the second image data for the gate line is displayed on the display section 3, in the half gradation.

After the image data is displayed in the half gradation, it is checked at a step S27 whether a scroll instruction is issued. When the scroll instruction is issued to the image drawing unit 1, the image drawing unit 1 outputs the memory control signal to the memory control circuit 6. The memory control circuit 6 updates the write and read start addresses and repeats the steps S21 to S26. When the scroll instruction is not issued, a step S28 is carried out. At the step S28, when the user operates the input unit 15 and instructs a screen display end (step S28-YES), the operation of the mobile terminal 16 ends.

As described above, according to the control driver 2 of the present invention, by adopting the above-mentioned structure of the display memory section 7 (the first display memory 7*a*, the second display memory 7*b*), the selection section (the first selector section 11, the second selector section 12, the third selector section 13) and the latch section 8, the wiring line intersections decrease. Therefore, according to the control driver 2 of the present invention, the miniaturization of the control driver can be realized (without increasing a chip size) and without increasing consumption power.

It should be noted that in the above-mentioned description, the scroll instruction is described. However, the image data stored in the first display memory 7*a* and the second display memory 7*b* may be applied to another function. For example, when the display section 3 contains a main display section and a sub display section which have the same structure as the display section 3 and the control driver 2 drives two display sections with one chip at the same time, the first image data which is stored in the first display memory 7*a* may be displayed on the main display section and the second image data which is stored in the second display memory 7*b* may be displayed to the sub display section.

In the above description, it is assumed that the upper portion is of 4 bits and the lower portion is of 4 bits, when the image data is composed of 8 bits. However, the present invention can be applied even when the number of bits of the upper portion is optional, and the lower portion is a bit portion of the image data other than the upper portion.

The control driver of the present invention can display the image data on the display section without increasing the consumption power.

The control driver of the present invention can display the image data on the display section without increasing the memory capacity of the display memory.

The control driver of the present invention can be made small in size.

What is claimed is:

1. A control driver comprising:

a display memory control section which generates a first process control signal when image data comprises only fist image data which has a pixel size equal to or smaller than that of a display section, and generates a second process control signal when said image data comprises first image data and second image data and said first image data has a pixel size is equal to that of said display section; and a display memory section which stores upper and lower portions of said first image data as first and second portions of display data in response to said first process control signal, and stores said upper portion of said first image data and an upper portion of said second image data as said first and second portions of said display data in response to said second process control signal, wherein said display data is displayed on said display section.

2. The control driver according to claim 1, wherein a number of bits of said upper portion of said first image data is optional.

3. A control driver comprising:

a display memory section which stores first and second portions of display data, wherein said first and second portions are upper and lower portions of a first image data in a first process when image data comprises only said first image data has a pixel size equal to or smaller than that of a display section on which said display data is displayed, and said first and second portions are said upper portion of said first image data and an upper portion of a second image data in a second process, when said image data comprises said first image data and second image data and said first image data has the pixel size equal to that of said display section;

a first selector section which outputs as said second portion, said lower portion of said first image data in said first process and said upper portion of said second image data in said second process to said display memory section;

a latch section which latches data supplied thereto;

a second selector section which outputs said first portion of said display data read out from said display memory section to said latch section in said first process, and said first portion of said read out display data for display of said first image data and said second portion of said read out display data for display of said second image data in said second process; and a third selector section which outputs said second portion of said display data to said latch section in said first process, and said first portion of said read out display data for display of said first image data and said second portion of said read out display data for display of said second image data in said second process.

4. The control driver according to claim 3, further comprising:

a data line driving circuit which drives data lines of said display section, based on gradation voltages and the latched data by said latch section.

5. The control driver according to claim 3, wherein said display memory section comprises:

a first display memory which stores said first portion of said display data; and a second display memory which stores said second portion of said display data.

6. The control driver according to claim 5, wherein said display memory section comprises:

a plurality of memory cells arranged in a matrix of columns and rows, said first display memory is formed from odd numbered columns, and said second display memory is formed from even numbered columns.

7. The control driver according to claim 6, wherein said second selector section comprises a plurality of second selectors which are provided for said odd numbered columns; and said third selector section comprises a plurality of third selectors which are provided for said even numbered columns, said odd numbered column for one of data bits of said first portion of said display data is provided in neighbor to said even numbered column for a data bit of said second portion corresponding to said data bit of said first portion, said data bit read out from said odd numbered column is connected with said second and third selectors corresponding to said odd numbered column and said even numbered column, and said data bit read out from said even numbered column is connected with said second and third selectors corresponding to said odd numbered column and said even numbered column.

8. The control driver according to claim 6, wherein rows of said memory cells of said odd numbered columns are connected with first word lines, rows of said memory cells of said even numbered columns are connected with second word lines, and said display memory section further comprises:

a word line decoder which selects one of said first word lines and one of said second word lines based on one of a write address and a read address.

9. The control driver according to claim 8, wherein said word line decoder selects one of said first word lines and one of said second word lines at a time based on said write address for a write operation of said first image data and based on said read address for a read operation of said first image data in said first process, said word line decoder selects one of said first word lines based on a first write address for a write operation of said upper portion of said first image data and selects one of said second word lines based on a second write address for a write operation of said upper portion of said second image data, and said word line decoder selects one of said first word lines based on a first read address for a read operation of said upper portion of said first image data and selects one of said second word lines based on a second read address for a write operation of said upper portion of said second image data.

10. A display apparatus comprising:

an image drawing unit which outputs an image data of a first image data or of said first image data and a second image data;

a gradation voltage generating circuit which generates gradation voltages;

a display section which is connected data lines; and a control driver, which comprises:

a display memory control section which generates a first process control signal when said image data comprises only fist image data which has a pixel size equal to or smaller than that of said display section, and generates a second process control signal when said image data comprises first image data and said second image data and said first image data has a pixel size is equal to that of said display section; and a display memory section which stores upper and lower portions of said first image data as first and second portions of display data in response to said first process control signal, and stores said upper portion of said first image data and an upper portion of said second image data as said first and second portions of said display data in response to said second process control signal, wherein said display data is displayed on said display section based on said gradation voltages.

11. The display apparatus according to claim 10, wherein said control driver further comprises:

a first selector section which outputs as said second portion, said lower portion of said first image data to said display memory section in said first process control signal and said upper portion of said second image data to said display memory section in said second process control signal;

a latch section which latches data supplied thereto;

a second selector section which outputs said first portion of said display data read out from said display memory section to said latch section in response to said first process control signal, and said first portion of said read out display data for display of said first image data and said second portion of said read out display data for display of said second image data in said second process control signal; and a third selector section which outputs said second portion of said display data to said latch section in said first process control signal, and said first portion of said read out display data for display of said first image data and said second portion of said read out display data for display of said second image data in said second process control signal.

12. The display apparatus according to claim 10, wherein said control driver further comprises:

a data line driving circuit which drives said data lines of said display section based on gradation voltages and the latched data by said latch section.

13. The display apparatus according to claim 10, wherein said display memory section comprises:

a first display memory which stores said first portion of said display data; and a second display memory which stores said second portion of said display data.

14. The display apparatus according to claim 13, wherein said display memory section comprises:

a plurality of memory cells arranged in a matrix of columns and rows, said first display memory is formed from odd numbered columns, and said second display memory is formed from even numbered columns.

15. The display apparatus according to claim 14, wherein said second selector section comprises a plurality of second selectors which are provided for said odd numbered columns; and said third selector section comprises a plurality of third selectors which are provided for said even numbered columns, said odd numbered column for one of data bits of said first portion of said display data is provided in neighbor to said even numbered column for a data bit of said second portion corresponding to said data bit of said first portion, said data bit read out from said odd numbered column is connected with said second and third selectors corresponding to said odd numbered column and said even numbered column, and said data bit read out from said even numbered column is connected with said second and third selectors corresponding to said odd numbered column and said even numbered column.

16. The display apparatus according to claim 14, wherein rows of said memory cells of said odd numbered columns are connected with first word lines, rows of said memory cells of said even numbered columns are connected with second word lines, and said display memory section further comprises:

a word line decoder which selects one of said first word lines and one of said second word lines based on one of a write address and a read address.

17. The display apparatus according to claim 16, wherein said word line decoder selects one of said first word lines and one of said second word lines at a time based on said write address for a write operation of said first image data and based on said read address for a read operation of said first image data in said first process, said word line decoder selects one of said first word lines based on a first write address for a write operation of said upper portion of said first image data and selects one of said second word lines based on a second write address for a write operation of said upper portion of said second image data, and said word line decoder selects one of said first word lines based on a first read address for a read operation of said upper portion of said first image data and selects one of said second word lines based on a second read address for a write operation of said upper portion of said second image data.

18. A mobile terminal comprising:

an input unit used to supply an image data and a scroll instruction; and a display apparatus, wherein said display apparatus comprises:

an image drawing unit which outputs an image data of a first image data or of said first image data and a second image data;

a gradation voltage generating circuit which generates gradation voltages;

a display section which is connected data lines, wherein said first image data has a same pixel size as that of said display section; and a control driver, wherein said control driver comprises:

a display memory control section which generates a first process control signal when said image data comprises only fist image data which has a pixel size equal to or smaller than that of said display section, and generates a second process control signal when said image data comprises first image data and said second image data and said first image data has a pixel size is equal to that of said display section; and a display memory section which stores upper and lower portions of said first image data as first and second portions of display data in response to said first process control signal, and stores said upper portion of said first image data and an upper portion of said second image data as said first and second portions of said display data in response to said second process control signal, wherein said display data is displayed on said display section based on said gradation voltages.

19. The mobile terminal according to claim 18, wherein said control driver further comprises:

a first selector section which outputs as said second portion, said lower portion of said first image data to said display memory section in said first process control signal and said upper portion of said second image data to said display memory section in said second process control signal;

a latch section which latches data supplied thereto;

a second selector section which outputs said first portion of said display data read out from said display memory section to said latch section in response to said first process control signal, and said first portion of said read out display data for display of said first image data and said second portion of said read out display data for display of said second image data in said second process control signal; and a third selector section which outputs said second portion of said display data to said latch section in said first process control signal, and said first portion of said read out display data for display of said first image data and said second portion of said read out display data for display of said second image data in said second process control signal.

20. The mobile terminal according to claim 18, wherein said control driver further comprises:

a data line driving circuit which drives said data lines of said display section based on gradation voltages and the latched data by said latch section.

21. The mobile terminal according to claim 18, wherein said display memory section comprises:

a first display memory which stores said first portion of said display data; and a second display memory which stores said second portion of said display data.

22. The mobile terminal according to claim 21, wherein said display memory section comprises:

a plurality of memory cells arranged in a matrix of columns and rows, said first display memory is formed from odd numbered columns, and said second display memory is formed from even numbered columns.

23. The mobile terminal according to claim 22, wherein said second selector section comprises a plurality of second selectors which are provided for said odd numbered columns; and said third selector section comprises a plurality of third selectors which are provided for said even numbered columns, said odd numbered column for one of data bits of said first portion of said display data is provided in neighbor to said even numbered column for a data bit of said second portion corresponding to said data bit of said first portion, said data bit read out from said odd numbered column is connected with said second and third selectors corresponding to said odd numbered column and said even numbered column, and said data bit read out from said even numbered column is connected with said second and third selectors corresponding to said odd numbered column and said even numbered column.

24. The mobile terminal according to claim 22, wherein rows of said memory cells of said odd numbered columns are connected with first word lines, rows of said memory cells of said even numbered columns are connected with second word lines, and said display memory section further comprises:

a word line decoder which selects one of said first word lines and one of said second word lines based on one of a write address and a read address.

25. The mobile terminal according to claim 24, wherein said word line decoder selects one of said first word lines and one of said second word lines at a time based on said write address for a write operation of said first image data and based on said read address for a read operation of said first image data in said first process, said word line decoder selects one of said first word lines based on a first write address for a write operation of said upper portion of said first image data and selects one of said second word lines based on a second write address for a write operation of said upper portion of said second image data, and said word line decoder selects one of said first word lines based on a first read address for a read operation of said upper portion of said first image data and selects one of said second word lines based on a second read address for a write operation of said upper portion of said second image data.

26. A method of displaying an image data on a display section, comprising:

determining whether a pixel size of said image data is larger than a pixel size of said display section;

writing upper and lower portions of a first image data in first and second display memories when the pixel size of said image data is not larger than that of said display section and said image data contains only said first image data;

writing said upper portion of said first image data in said first display memory when the pixel size of said image data is larger than that of said display section and said image data contains said first image data and a second image data; and writing an upper portion of said second image data in said second display memory after the write of said upper portion of said first image data.

27. The method of displaying an image data on a display section, according to claim 26, further comprising:

reading out said upper and lower portions of said first image data from said first and second display memories such that said image data is displayed on said display section in a full gradation, when the pixel size of said image data is not larger than that of said display section and said image data contains only said first image data;

reading out said upper portion of said first image data from said first display memory such that said first image data is displayed on said display section in a half gradation, when the pixel size of said image data is not larger than that of said display section and said image data contains said first image data and said second image data; and reading out said upper portion of said first image data from said first display memory such that said first and second image data are displayed on said display section in said half gradation, in response to a scroll instruction after the read of said upper portion of said first image data.

28. The method of displaying an image data on a display section, according to claim 26, wherein a number of bits of said upper portion of said first image data is optional.

* * * * *